US007614188B2

(12) United States Patent
Hetherington et al.

(10) Patent No.: US 7,614,188 B2
(45) Date of Patent: Nov. 10, 2009

(54) CORNER KEY WITH PATHWAY

(75) Inventors: Richard W. Hetherington, Bend, OR (US); Kevin A. Campbell, Klamath Falls, OR (US)

(73) Assignee: Jeld-Wen, inc., Klamath Falls, OR (US)

( * ) Notice: Subject to any disclaimer, the term of this patent is extended or adjusted under 35 U.S.C. 154(b) by 631 days.

(21) Appl. No.: 10/793,322

(22) Filed: Mar. 4, 2004

(65) Prior Publication Data

US 2005/0223661 A1 Oct. 13, 2005

(51) Int. Cl.
*E06B 3/00* (2006.01)
*E04C 2/38* (2006.01)

(52) U.S. Cl. ..... 52/204.58; 52/658

(58) Field of Classification Search ..... 52/204.57, 52/204.58, 658, 655.1, 204.55
See application file for complete search history.

(56) References Cited

U.S. PATENT DOCUMENTS

| | | | | |
|---|---|---|---|---|
| 3,434,749 | A | 3/1969 | Meyer | |
| 3,782,054 | A | 1/1974 | Goss, Jr. | |
| 3,965,560 | A | 6/1976 | Jackson | |
| 4,024,691 | A | 5/1977 | Hansen et al. | |
| 4,037,378 | A * | 7/1977 | Collins et al. | 52/204.591 |
| 4,124,322 | A | 11/1978 | Parisien | |
| 4,502,260 | A | 3/1985 | Machler | |
| 4,513,546 | A | 4/1985 | Gow | |
| 4,578,903 | A | 4/1986 | Simpson | |
| 5,014,466 | A | 5/1991 | Winner | |
| 5,105,581 | A | 4/1992 | Slocomb, Jr. | 49/504 |
| 5,547,011 | A | 8/1996 | Dotson et al. | |
| 5,806,256 | A | 9/1998 | Byrne | |
| 6,047,514 | A * | 4/2000 | Verch | 52/656.5 |
| 6,067,760 | A * | 5/2000 | Nowell | 52/204.57 |
| 6,073,412 | A * | 6/2000 | Verch | 52/656.5 |
| 6,108,997 | A | 8/2000 | Blais et al. | |
| 2005/0115178 | A1 | 6/2005 | Schmidt | 52/272 |
| 2006/0096190 | A1 | 5/2006 | Baczuk et al. | 52/204.1 |
| 2007/0137134 | A1 | 6/2007 | Plagemann et al. | 52/656.9 |

FOREIGN PATENT DOCUMENTS

| | | |
|---|---|---|
| GB | 2128237 | 4/1984 |

(Continued)

OTHER PUBLICATIONS

LCS On-Line Catalog © 2001, 2002, 2003, LCS Precision Molding Web Site.

(Continued)

*Primary Examiner*—Richard E Chilcot, Jr.
*Assistant Examiner*—Jessica Laux
(74) *Attorney, Agent, or Firm*—Stoel Rives LLP

(57) ABSTRACT

Products and processes for forming structural assemblies for building systems, such as window and door assemblies, are described. One such product includes an apparatus comprising a first end and a second end opposite the first end. A first leg and a second leg are disposed between the first and second ends. A first receiving groove is disposed in the first leg and forms a first pathway. A second receiving groove is disposed in the second leg and forms a second pathway.

23 Claims, 9 Drawing Sheets

FOREIGN PATENT DOCUMENTS

| | | | |
|---|---|---|---|
| GB | 2140853 | | 12/1984 |
| GB | 2228546 | A | 8/1990 |
| GB | 2378975 | | 2/2003 |
| JP | 2001123756 | | 5/2001 |
| JP | 2002138768 | | 5/2002 |

OTHER PUBLICATIONS

Brochure for CK-20 PVC Window System; Feneglobe Systems, Ltd.

Presentation of the Corner Key Window System With Mechanical Assembly, presented by Feneglobe Systems, Ltd.

* cited by examiner

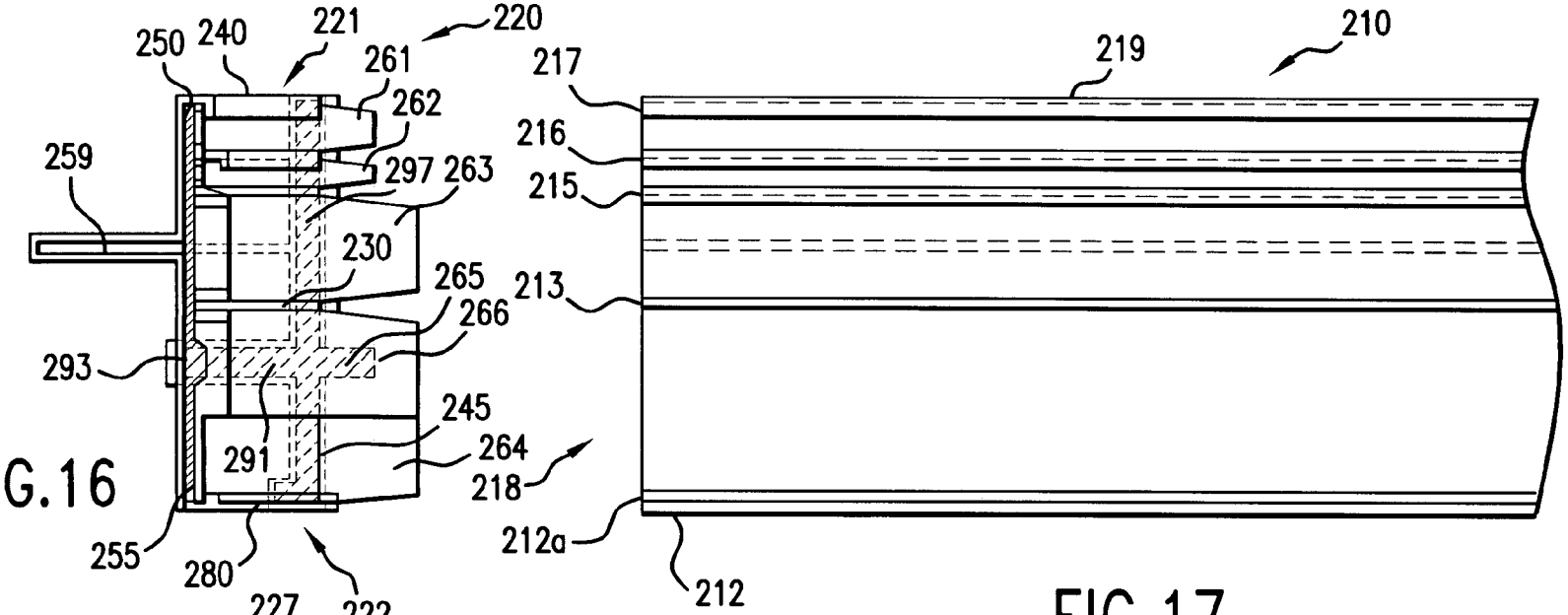
FIG. 17
FIG. 16
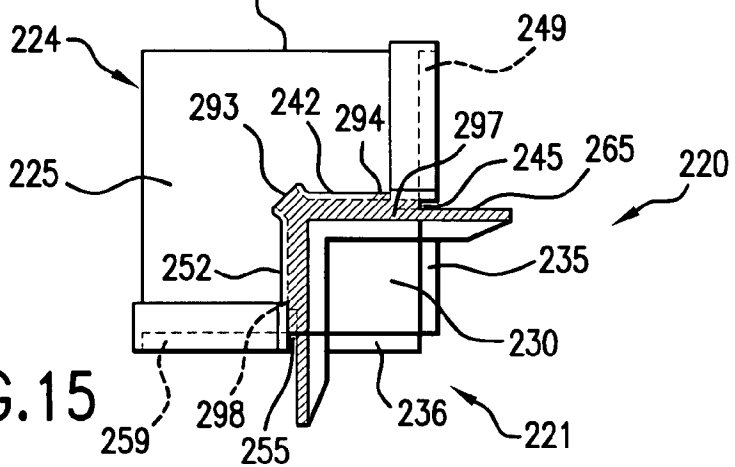
FIG. 15

CORNER KEY WITH PATHWAY

FIELD OF THE INVENTION

This invention relates generally to structural components for building systems, and more particularly to corner keys for windows and doors.

BACKGROUND

Aluminum windows are generally formed by joining together a plurality of separate frame extrusions. Joining the frame extrusions together, i.e., coping, typically includes mitering two adjoining surfaces at right angles, i.e., 90 degrees. This method provides relatively few bearing surfaces that can be sealed to prevent water penetration or leakage into a window assembly. Both interior and exterior joints—but primarily exterior joints—are water infiltration points. Manufacturers of windows seek to eliminate water infiltration.

Gaskets and sealants have been applied to coped corners in a variety of methods and configurations in an attempt to seal the joints and prevent water from leaking into the finished window assembly. Sealants, such as silicone-based compounds or urethane-based compounds, are ordinarily manually applied, subjecting the process to human error. There is a risk of applying insufficient sealant or misapplying sealant. Gaskets are subject to similar problems, in that they are ordinarily manually applied. Misapplied gaskets can be tom by corners of the aluminum extrusions.

A corner key forms a corner joint and connects and aligns adjoining frame members. Conventional corner keys include those described in U.S. Pat. No. 6,067,760 to Nowell and U.S. Pat. No. 6,073,412 to Verch. Corner keys have been used in manufacturing aluminum windows to reduce manufacturing time. Known corner keys are generally hollow and injected with a sealant to retain the adjoining extrusions together. Methods used to inject the sealant into the corner key ordinarily require that at least one aluminum extrusion be pierced. The pierced aluminum extrusion is then manually sealed, usually with a gasket or another sealant. Over time or with handling of the window, the structural integrity of the gasket or seal can degrade or be compromised, which can create an access point for water to leak into the window.

What is needed are products and processes to reduce the susceptibility of a window to water leakage.

SUMMARY

The present invention comprises products and processes for forming structural assemblies for building systems, such as window and door assemblies. In one exemplary embodiment, an apparatus comprises a first end and a second end opposite the first end. A first leg and a second leg are disposed between the first and second ends. A first receiving groove is disposed in the first leg and forms a first pathway. A second receiving groove is disposed in the second leg and forms a second pathway.

In another exemplary embodiment, an assembly comprises a frame member and a corner key. The frame member comprises a first end and a second end. The first end comprises a web. The corner key comprises a first end and a second end opposite the first end. The corner key also comprises a first leg and a second leg disposed between the first and second ends. A first receiving groove is disposed in the first leg and forms a first pathway. A second receiving groove is disposed in the second leg and forms a second pathway.

In a further exemplary embodiment, a method comprises providing a corner key and a frame member. The corner key comprises a first end, a second end opposite the first end, a projection, and a pathway disposed in the corner key. The frame member comprises a first end, a second end, and a web. The method also comprises coupling the first end of the corner key and the first end of the frame member, coupling the projection of the corner key and the web of the frame member, and injecting a sealant into the pathway of the corner key.

An advantage of the present invention can be to provide a leak-free window or door frame assembly.

Another advantage of the present invention can be to provide a corner key with an integral sealant pathway.

Another advantage of the present invention can be to provide a corner key that can be injected with sealant without piercing an aluminum frame member.

Another advantage of the present invention can be to reduce an amount of material, such as aluminum, used to manufacture a window or door assembly.

Yet another advantage of the present invention can be to couple ends of a window or door frame assembly without mitering or coping ends of the frame members.

Still another advantage of the present invention can be to reduce time and costs of manufacturing and assembling window or door frame assemblies.

A further advantage of the present invention can be to reduce the potential for human error in the manufacture and assembly of window or door frame assemblies.

Still a further advantage of the present invention can be to provide improved structural integrity in the corners of a window or door assembly.

These exemplary embodiments are mentioned not to summarize the invention, but to provide an example of an embodiment of the invention to aid understanding. Exemplary embodiments are discussed in the Detailed Description, and further description of the invention is provided there. Advantages offered by the various embodiments of the present invention may be understood by examining this specification.

BRIEF DESCRIPTION OF THE DRAWINGS

The accompanying drawings, which constitute part of this specification, help to illustrate the embodiments of the invention. In the drawings, like numerals are used to indicate like elements throughout.

FIG. 15 is a side view of a corner key according to an embodiment of the invention.

FIG. 16 is a bottom view of the corner key of FIG. 15.

FIG. 17 is a bottom view of a frame member of a window assembly according to the present invention.

DETAILED DESCRIPTION

Figure 1:
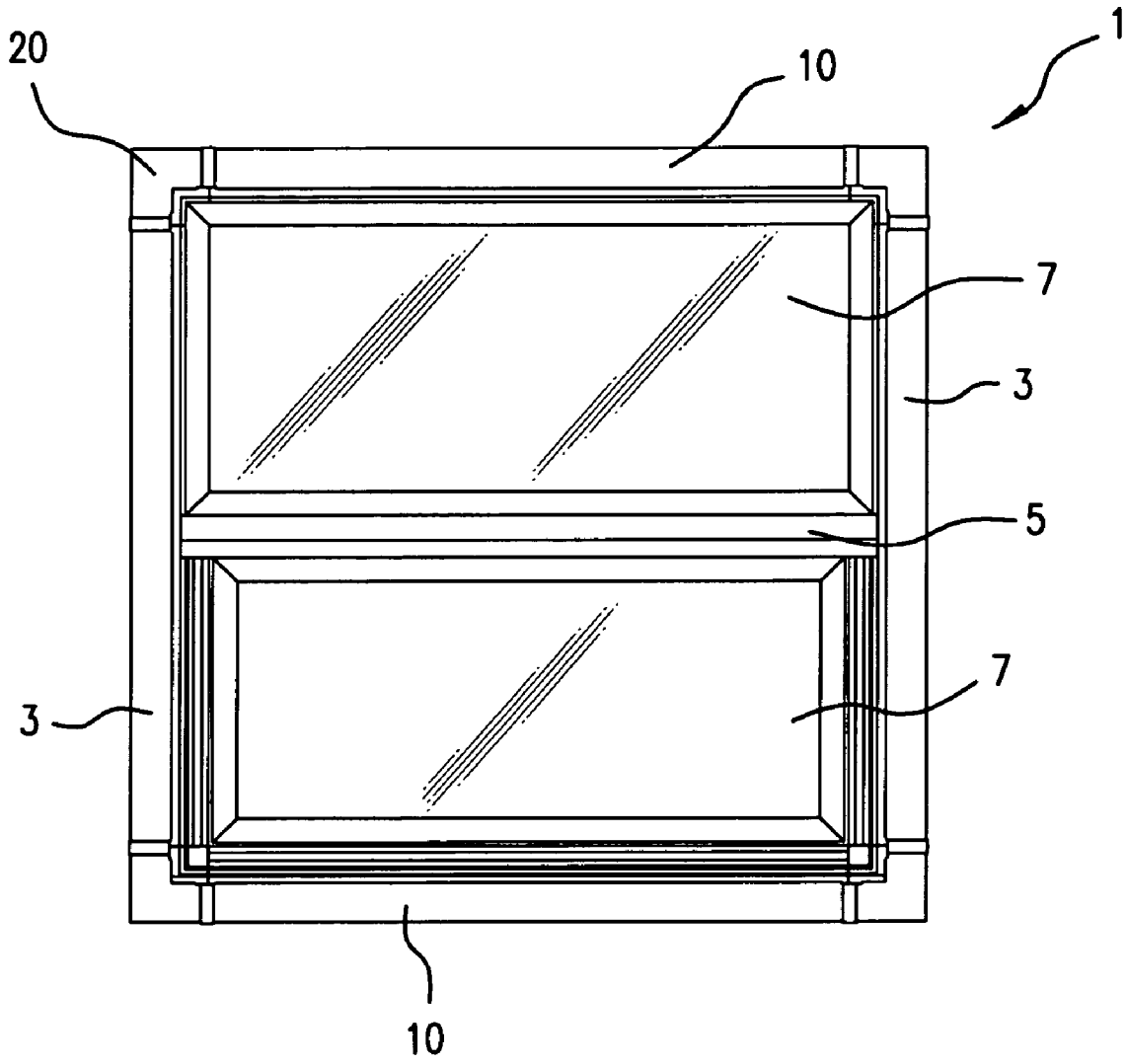
FIG. 1 is a window assembly according to an embodiment of the invention.

Embodiments of the present invention comprise products and processes for forming structural assemblies for building systems, such as window and door assemblies. Referring now to FIG. 1, a perspective view of a window assembly 1 according to the principles of the present invention is shown. The window assembly 1 generally comprises a plurality of frame members, such as side jambs 3 and head 10, which form a perimeter that defines a rectangular-like shape. Alternatively, other suitable shapes are used, such as square, polygonal, or arcuate shapes. As will be described in more detail below, the side jambs 3 and head 10 are formed of extruded aluminum.

Typically, there are two substantially parallel side jambs 3 and substantially parallel head 10. Also typically, the side jambs 3 are disposed substantially perpendicular to the head 10. Coupling the side jambs 3 and the head 10 are a plurality of corner keys 20. Typically, one corner key 20 is disposed in each corner of the window assembly 1.

The corner key 20 can be made of a polycarbon material. An example of one such suitable material includes a thermoplastic polyester resin manufactured by E.I. DuPont de Nemours and Co. under the trade-name Crastin®. Another suitable polycarbon material is manufactured under the trade-name Syntrex. Generally, suitable materials for the corner key 20 are typically UV-stable (e.g., resist colorization) and dimensionally stable. Accordingly, such suitable materials resist appreciable colorization and deformation due to physical and/or thermal stresses. The corner key 20 is generally formed by a multi-die injection process. Alternatively, other suitable materials and forming methods can be used for the corner key 20.

Disposed within the perimeter formed by the side jambs 3 and head 10, is an interior of the window assembly 1. The interior includes a glass assembly 7. In one embodiment, there are two separate glass assemblies 7 separated by a meeting rail 5. Generally, such glass assemblies 7 are operable to be displaced with respect to the side jambs 3. In an alternate embodiment, the glass assemblies 7 are fixed, and thus, cannot be displaced. In still another alternate embodiment, there is a unitary glass assembly 7 disposed within the perimeter formed by the side jambs 3 and head 10.

Referring now to FIGS. 2-5, perspective views of the corner key 20 according to an embodiment of the present invention are shown. The corner key 20 described below can be used for manufacturing or assembling window assemblies. Alternatively, the corner key 20 can be used in other suitable assemblies, such as, for example, doors.

The corner key 20 described below can be modified in accordance with the principles of the present invention for use with a wide variety of window or door frame assemblies, in addition to that described herein. Furthermore, the corner key 20 can be modified to accommodate different positions of the corner key 20 with respect to a window assembly, such as, for example, disposing the corner key 20 on an inside or an outside of the window assembly 1. Accordingly, an exemplary embodiment of the corner key 20 will be described below.

The corner key 20 comprises a first end 21 and a second end 22. The second end 22 is disposed opposite the first end 21. Disposed between the first end 21 and the second end 22 are a first leg 40 and a second leg 50. The second leg 50 is disposed substantially perpendicular to the first leg 40. Alternatively, the second leg 50 is disposed in other suitable positions with respect to the first leg 40.

The first leg 40 comprises a first surface 41 and a second surface 42. Typically, the first surface 41 and the second surface 42 are generally planar and are substantially parallel to one another. In one embodiment, a first edge 43 is disposed between and couples the first surface 41 and the second surface 42 proximate to the first end 21. The first edge 43 is generally perpendicular to the first surface 41 and the second surface 42.

A second edge 44 generally is disposed between and couples the first surface 41 and the second surface 42 proximate to the second end 22. The second edge 44 is generally perpendicular to the first surface 41 and the second surface 42. The first edge 43 and the second edge 44 are generally parallel to one another.

The second leg 50 comprises a first surface 51 and a second surface 52. Typically, the first surface 51 and the second surface 52 are generally planar and are substantially parallel to one another. In one embodiment, a first edge 53 is disposed between and couples the first surface 51 and the second surface 52 proximate to the first end 21. The first edge 53 is generally perpendicular to the first surface 51 and the second surface 52. In one embodiment, the first surface 41 of the first leg 40 is disposed adjacent to the first surface 51 of the second leg 50 and the second surface 42 of the first leg 40 is disposed adjacent to the second surface 52 of the second leg 50.

A second edge 54 generally is disposed between and couples the first surface 51 and the second surface 52 proximate to the second end 22. The second edge 54 is generally perpendicular to the first surface 51 and the second surface 52. The first edge 53 and the second edge 54 are generally parallel to one another. In one embodiment, the corner key 20 is substantially solid. In another embodiment, the corner key 20 is substantially hollow.

In one embodiment, an end wall 80 is disposed substantially coplanar with the second end 22. Generally, the end wall 80 comprises a first surface 81 and a second surface 82. The first surface 81 and the second surface 82 are generally planar surfaces and are substantially parallel to one another. The first surface 81 of the end wall 80 typically is coupled to and extends perpendicularly from the first surface 41 of the first leg 40 and the first surface 51 of the second leg 50. The first surface 81 of the end wall 80 typically faces the first end 21.

The second surface 82 of the end wall 80 typically is coupled to and extends from the second edge 44 of the first leg 40 and the second edge 54 of the second leg 50. Generally, the second surface 82 of the end wall 80 is substantially coplanar with both the second edge 44 of the first leg 40 and the second edge 54 of the second leg 50.

In one embodiment, the first surface 81 of the end wall 80, the second surface 82 of the end wall 80, and the first surface 41 of the first leg 40 define a first end receiving channel 83. The first end receiving channel 83 generally extends perpendicularly from the first surface 41 of the first leg 40. In another embodiment, the first surface 81 of the end wall 80, the second surface 82 of the end wall 80, and the first surface 51 of the second leg 50 define a second end receiving channel 85. The second end receiving channel 85 generally extends perpendicularly from the first surface 51 of the second leg 50. As will be described in more detail below, the first end receiving channel 83 and the second end receiving channel 85 each are adapted to couple with a portion of a frame member. Alternatively, other suitable arrangements and configurations can be used.

In one embodiment, a medial wall 30 is disposed between the first end 21 and the second end 22. Typically, the medial wall 30 is disposed substantially parallel to the end wall 80. Generally, the medial wall 30 comprises a first surface 31 and a second surface 32. The first surface 31 and the second surface 32 are generally planar surfaces and are substantially parallel to one another. The first surface 31 of the medial wall 30 typically is coupled to and extends perpendicularly from the first surface 41 of the first leg 40 and the first surface 51 of the second leg 50. The first surface 31 of the medial wall 30 typically faces the first end 21.

The second surface 32 of the medial wall 30 typically is coupled to and extends perpendicularly from the first surface 41 of the first leg 40 and the first surface 51 of the second leg 50. Generally, the second surface 32 of the medial wall 30 faces the first surface 81 of the end wall 80.

In one embodiment, an injection port 93 is disposed proximate to the second end 22 and proximate to a spine 96. The spine 96 comprises a surface or an edge formed by a junction of the second surface 42 of the first leg 40 and the second surface 52 of the second leg 50. The injection port 93 is adapted to accept or receive sealant injected into the corner key 20. The injection port 93 is generally circular in shape and is circumscribed by sufficient material to provide the injection port 93 with sufficient rigidity to remain dimensionally stable when injecting sealant into the corner key 20. Alternatively, other suitable shapes and configurations can be used.

A first receiving groove 45 is disposed in the first leg 40 and is in communication with the injection port 93. The first receiving groove 45 forms a first pathway (best shown in FIGS. 6 and 7), which provides a course for sealant to travel. The terms "communicate" and "communication" mean to mechanically or otherwise contact, couple, or connect by direct, indirect, and/or operational means.

Figure 5:
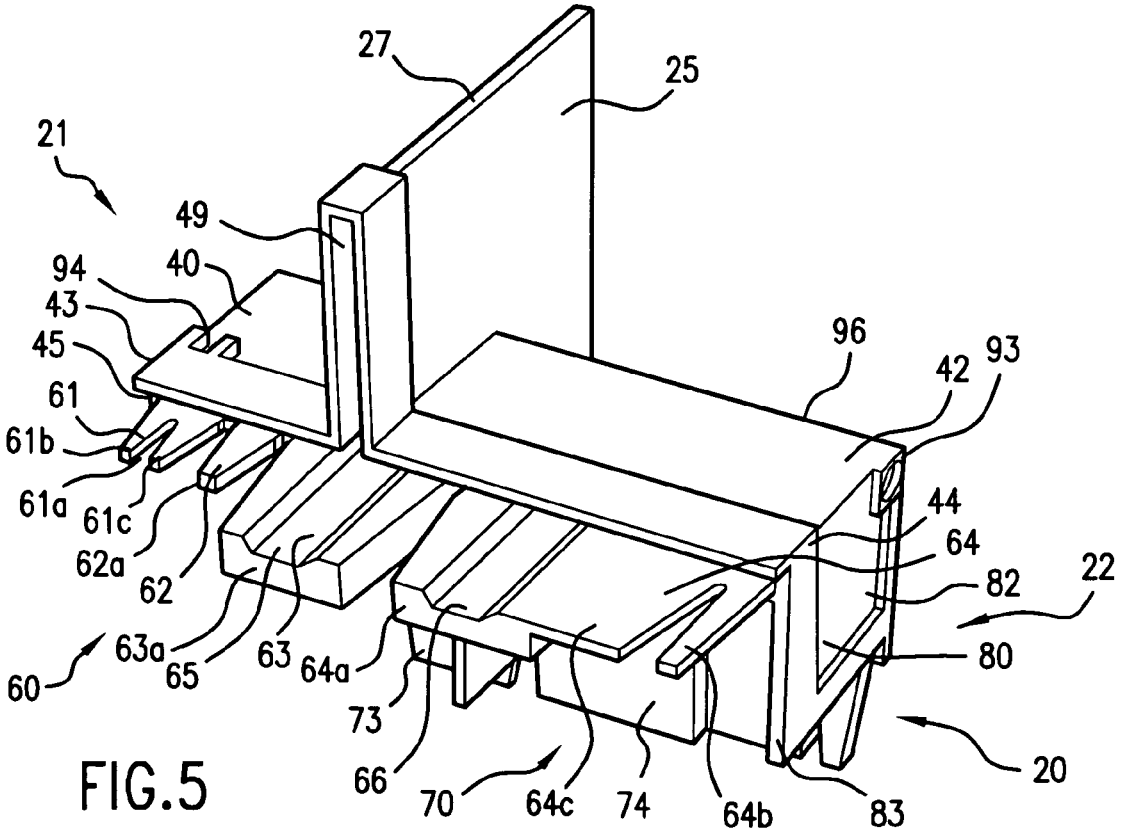
FIG. 5 is yet another perspective view of the corner key of FIG. 2.

As best shown in FIG. 5, the first receiving groove 45 typically extends along an entire length of the first leg 40 from the first edge 43 the second edge 44. As will be described in more detail below, the first receiving groove 45 is adapted to receive a portion of a frame member of the window assembly 1. Alternatively, other suitable configurations of the first receiving groove 45 are possible.

Figure 3:
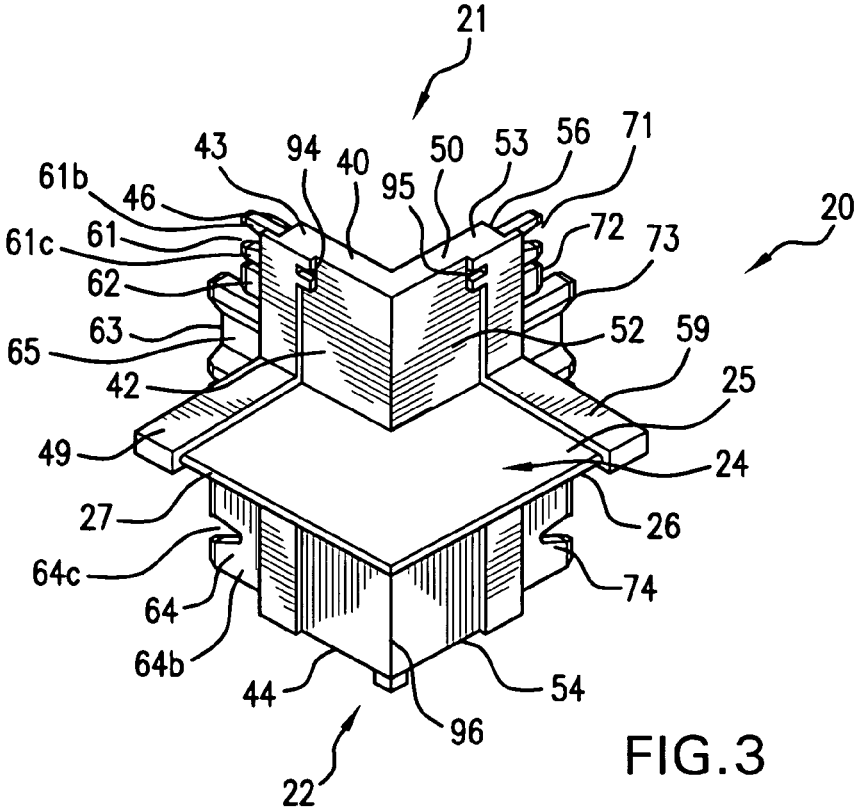
FIG. 3 is another perspective view of the corner key of FIG. 2.
Figure 4:
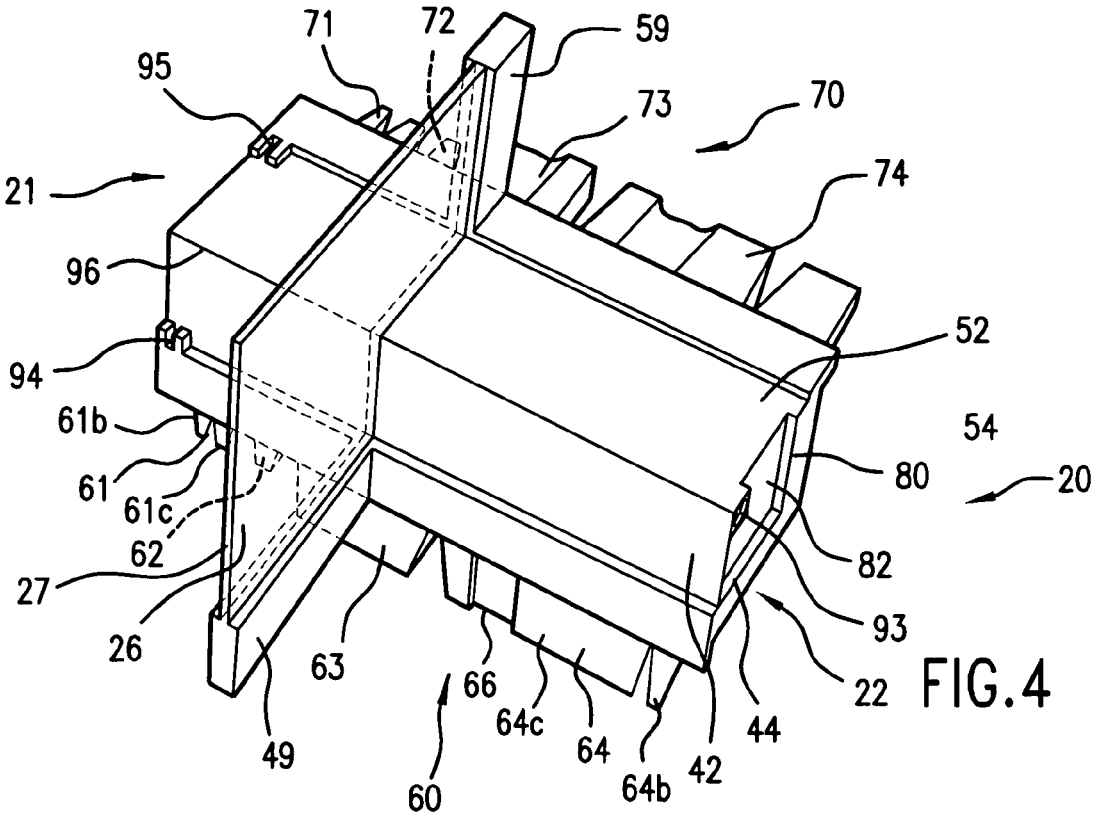
FIG. 4 is still another perspective view of the corner key of FIG. 2.

As best seen in FIGS. 3 and 4, a first expulsion port 94 is in communication with the first receiving groove 45. The first expulsion port 94 is disposed in the first surface 42 of the first leg 40. The first expulsion port 94 is adapted to permit sealant, as well as a fluid or a gas, to escape or vent from the first receiving groove 45. In one embodiment, the first expulsion port 94 is disposed proximate to the first end 21. Alternatively, other suitable arrangements and configurations for the first expulsion port 94 can be used.

A second receiving groove 55 is disposed in the second leg 50 and is in communication with the injection port 93. The second receiving groove 55 forms a second pathway (best shown in FIGS. 6 and 7), which provides a course for sealant to travel. The second receiving groove 55 typically extends along an entire length of the second leg 50 from the first edge 53 the second edge 54. The second receiving groove 55 is adapted to receive a portion of a frame member of the window assembly 1. Alternatively, other suitable configurations of the second receiving groove 55 are possible.

As best seen in FIGS. 3 and 4, a second expulsion port 95 is in communication with the second receiving groove 55. The second expulsion port 95 is disposed in the first surface 52 of the first leg 50. The second expulsion port 95 is adapted to permit sealant, as well as a fluid or a gas, to escape or vent from the second receiving groove 55.

In one embodiment, the second expulsion port 95 is disposed proximate to the first end 21. Alternatively, other suitable arrangements and configurations for the second expulsion port 95 can be used. In one embodiment, the first receiving groove 45, the second receiving groove 55, the injection port 93, the first expulsion port 94 and the second expulsion 95 port are all in communication.

In one embodiment, a first receiving channel 49 is in communication with the first receiving groove 45. Generally, the first receiving channel 49 is disposed substantially perpendicular to the first receiving groove 45. The second receiving channel 59 is adapted to receive a portion of a frame member of the window assembly 1. Typically, the first receiving channel 49 is disposed substantially perpendicular to the first surface 42 of the first leg 40. The first receiving channel 49 is typically disposed between the injection port 93 and the first expulsion port 94.

In one embodiment, a second receiving channel 59 in communication with the second receiving groove 55. Generally, the second receiving channel 59 is disposed substantially perpendicular to the second receiving groove 55. The second receiving channel 59 is adapted to receive a portion of a frame member of the window assembly 1. In one embodiment, the second receiving channel 59 is disposed opposite the first receiving channel 49. Typically, the second receiving channel 59 is disposed substantially perpendicular to the first surface 52 of the second leg 50. The second receiving channel 59 is typically disposed between the injection port 93 and the second expulsion port 95.

In one embodiment, a fin 24 is coupled to the second surface 42 of the first leg 40 and the second surface 52 of the second leg 50. The fin 24 is adapted to provide a surface with which to couple the window assembly 1 to a building structure. For example, the window assembly 1, can be secured to a wall or underlying structural support by using one or more fasteners, such as a nail or a screw. In one embodiment, the fin 24 generally is referred to in the art as a nailing fin.

Generally, the fin 24 is disposed between the first receiving channel 49 and the second receiving channel 59. The fin 24 includes a first surface 25 and a second surface 27. The first surface 25 and the second surface 27 are generally planar and substantially parallel to one another. An edge 26 defines a perimeter of the fin 24 and couples the first surface 25 and the second surface 27. Alternatively, other suitable configurations are possible.

In one embodiment, the corner key 20 further comprises a first projection extending from the first leg 40 and a second projection extending from the second leg 50. Typically, the first projection comprises a plurality of first projections 60 and the second projection comprises a plurality of second projections 70. As shown in FIGS. 2-5, the plurality of first projections 60 comprises a first projection 61, a second projection 62, a third projection 63, and a fourth projection 64.

The plurality of first projections 60 generally are coupled to the second surface 42 of the first leg 40, and generally are disposed proximate to the first receiving groove 45. The plurality of first projections 60 extend substantially along an entire length of the first receiving groove 45. As will be described in more detail below, the plurality of first projections 60 are adapted to couple with a frame member of the window assembly 1.

The first projection 61 is disposed proximate to the first edge 43 of the first leg 40. The first projection 61 gradually tapers to a flat face 61*a*. In one embodiment, the first projection 61 is divided and forms a first prong 61*b* and a second prong 61*c*. The first prong 61*b* comprises a biasing member and is adapted to exert a biasing force against a portion of the frame member. Alternatively, other suitable configurations for the first projection 61 can be used. Surrounding the first projection 61 is a first abutment 46 and a second abutment 47. The first abutment is disposed proximate to the first edge 43 of the first leg 40.

The second projection 62 is disposed between the first projection 61 and the third projection 63. The second projection 62 extends to substantially the same length as the first projection 61 and also gradually tapers to a flat face 62*a*. Alternatively, other suitable configurations for the second projection 62 can be used. Surrounding the second projection 62 is the second abutment 47 and a third abutment 48.

The third projection 63 is disposed between the second projection 62 and the fourth projection 64. The third projection 63 extends beyond the length of the first projection 61 and the second projection 62. The third projection gradually tapers to a flat face 63*a*. Alternatively, other suitable configurations for the third projection 63 can be used. Surrounding the third projection 63 is the third abutment 48 and the first surface 31 of the medial wall 30.

On a face of the third projection 63 facing the second surface 42 of the first leg 40 is a projection channel 65. The projection channel 65 extends along the length of the fourth projection 64 and is in communication with the first receiving groove 45. Alternatively, other suitable arrangements and configurations can be used.

The fourth projection 64 is disposed between the third projection 63 and the second edge 44 of the first leg 40. The fourth projection 64 extends to substantially the same length as the third projection 63 and also gradually tapers to a flat face 64*a*. In one embodiment, the fourth projection is divided and forms a first prong 64*b* and a second prong 64*c*. The first prong 64*b* comprises a biasing member and is adapted to exert a biasing force against a portion of the frame member. A width of the first prong 64*b* generally is less than a width of the second prong 64*c*. Alternatively, other suitable configurations for the fourth projection 64 can be used. Surrounding the fourth projection 63 is the second surface 32 of the medial wall 30 and the first surface 81 of the end wall 80.

On a face of the fourth projection 64 facing the second surface 42 of the first leg 40 is a projection channel 66. The projection channel 66 extends along the length of the fourth projection 64 and is in communication with the first receiving groove 45. Alternatively, other suitable arrangements and configurations can be used.

The plurality of second projections 70 generally are coupled to the second surface 52 of the second leg 50, and generally are disposed proximate to the first receiving groove 55. The plurality of second projections 70 extend substantially along an entire length of the first receiving groove 55. The plurality of second projections 70 are adapted to couple with a frame member of a window assembly 1. As the plurality of second projections 70 are similar in configuration and arrangement to the plurality of first projections 60, the plurality of second projections 70 will not be described in further detail.

Figure 2:
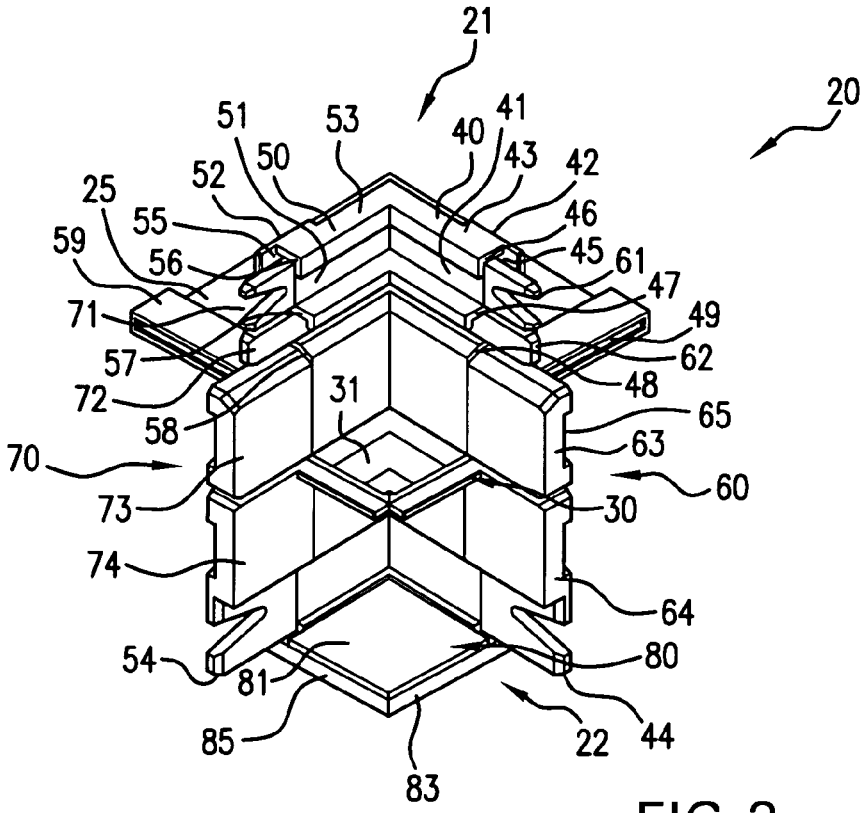
FIG. 2 is a perspective view of a corner key according to an embodiment of the present invention.
Figure 7:
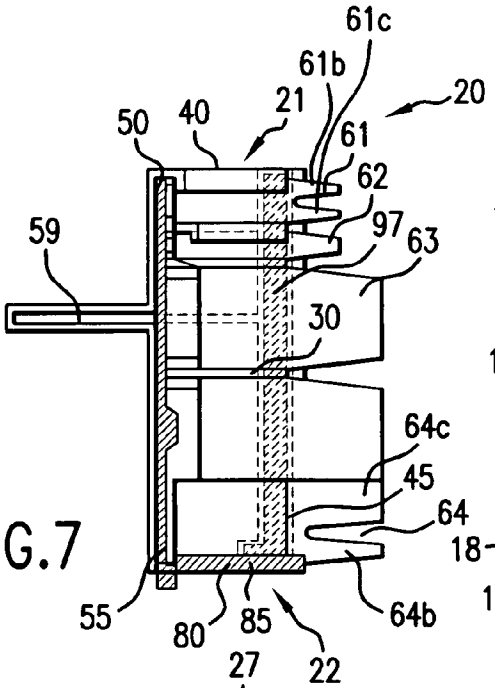
FIG. 7 is a bottom view of the corner key of FIG. 5.
Figure 6:
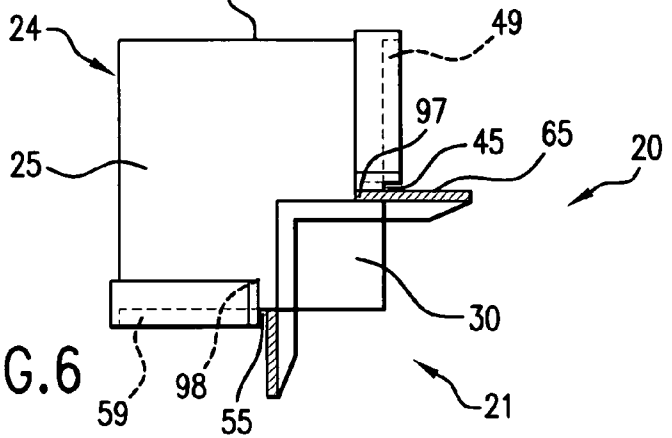
FIG. 6 is a side view of a corner key according to an embodiment of the invention.

Referring now to FIGS. 6 and 7, a first pathway 97 and portions of a second pathway 98 are shown. FIG. 6 is a side view of the corner key 20 of FIG. 2 and FIG. 7 is a bottom view of the corner key of FIG. 2. The cross-hatching in FIGS. 6 and 7 illustrates the first pathway 97 and the second pathway 98.

In one embodiment, the first pathway 97 is disposed in the first leg 40 and is defined by the first receiving groove 45, the injection port 93, and the first expulsion port 94. In another embodiment, the projection channel 65 of the third projection 63 and the projection channel 66 of the fourth projection 64 further define the first pathway. The second pathway 98 disposed in the second leg 50 will not be described here, as it is substantially similar to the first pathway 97. Alternatively, other suitable configurations and arrangements for the first and second pathways 97,98 can be used.

As described above, the first pathway 97 is adapted to receive and communicate a sealant (not shown). Generally, the sealant is a silicone-based compound or a urethane-based compound. Typically, the sealant is a structural sealant, such that the corner key 20 provides structural integrity to the corners of the window assembly 1. Other suitable sealants can be used.

In one embodiment, the sealant is a thermo-reaction urethane compound that is heated (before being injected) between approximately 230° F. (110° C.) and 265° F. (129° C.). In another embodiment, the sealant is heated to approximately 250° F. (121° C.).

Typically, the sealant is injected into the first pathway 97 through the injection port 93. The injected sealant is uniformly distributed through both the first leg 40 and the second leg 50. As the sealant fills the first pathway 97, excess sealant escapes through the first expulsion port 94. As described above, the first expulsion port 94 is adapted to vent gases from the sealant. Typically, cured or hardened sealant in the first pathway 97 prevents egress of the sealant from the first pathway 97 through either the injection port 93 or the first expulsion port 94. Alternatively, the first pathway 97 can be sealed or closed by other suitable means, such as, for example, mechanically attaching or adhering a cap or cover to either or both the injection port 93 and the first expulsion port 94.

As will be described in more detail below, the sealant couples the corner key 20 with a frame member, such as the head 10 (shown in FIG. 8). In one embodiment, the sealant adheres to both the corner key 20 and the head 10, thereby forming an adhesive bond between the corner key 20 and the head 10. As described in further detail below, a portion of the frame member 10 can be deformed such that the corner key 20 and frame member are coupled, such as for example, by friction or other mechanical means. Alternatively, the corner key 20 and the head 10 can be coupled by other suitable means.

Figure 8:
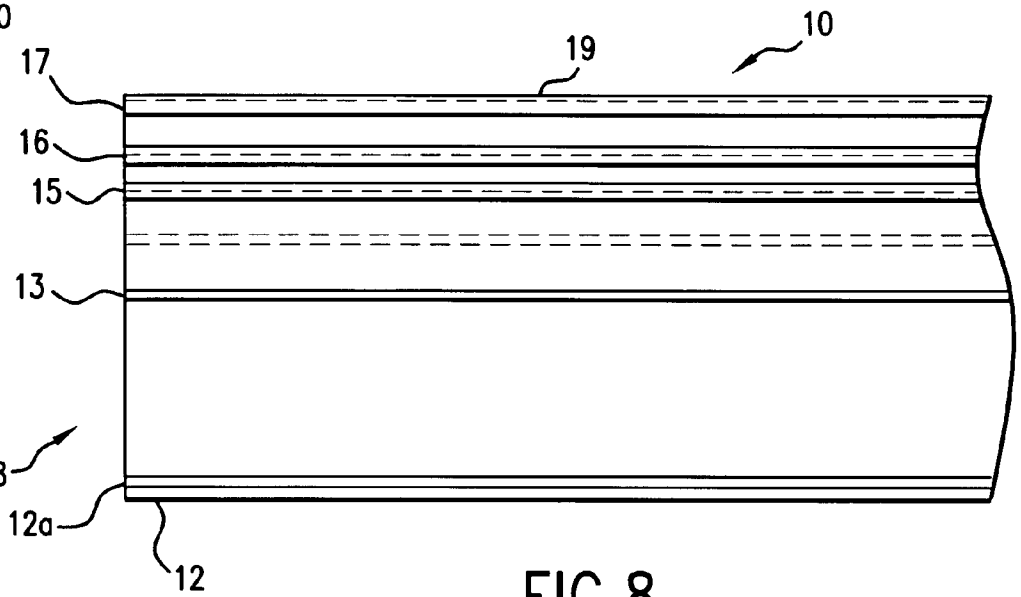
FIG. 8 is a bottom view of a frame member of a window assembly according to the present invention.

Referring now to FIG. 8, a bottom view of the head 10 is shown. As described above, the head 10 is adapted to couple with the corner key 20. The head 10 includes a first end 18 and a second end (not shown). A body 19 joins the first end 18 and the second end. Typically, the head 10 is made of an extruded aluminum. The other frame members of the window assembly 1, such as the side jamb and meeting rail, typically are also made of extruded aluminum. The first end 18 is disposed proximate to the first leg 40 of the corner key 20. Alternatively, other suitable configurations and materials can be used.

Figure 9:
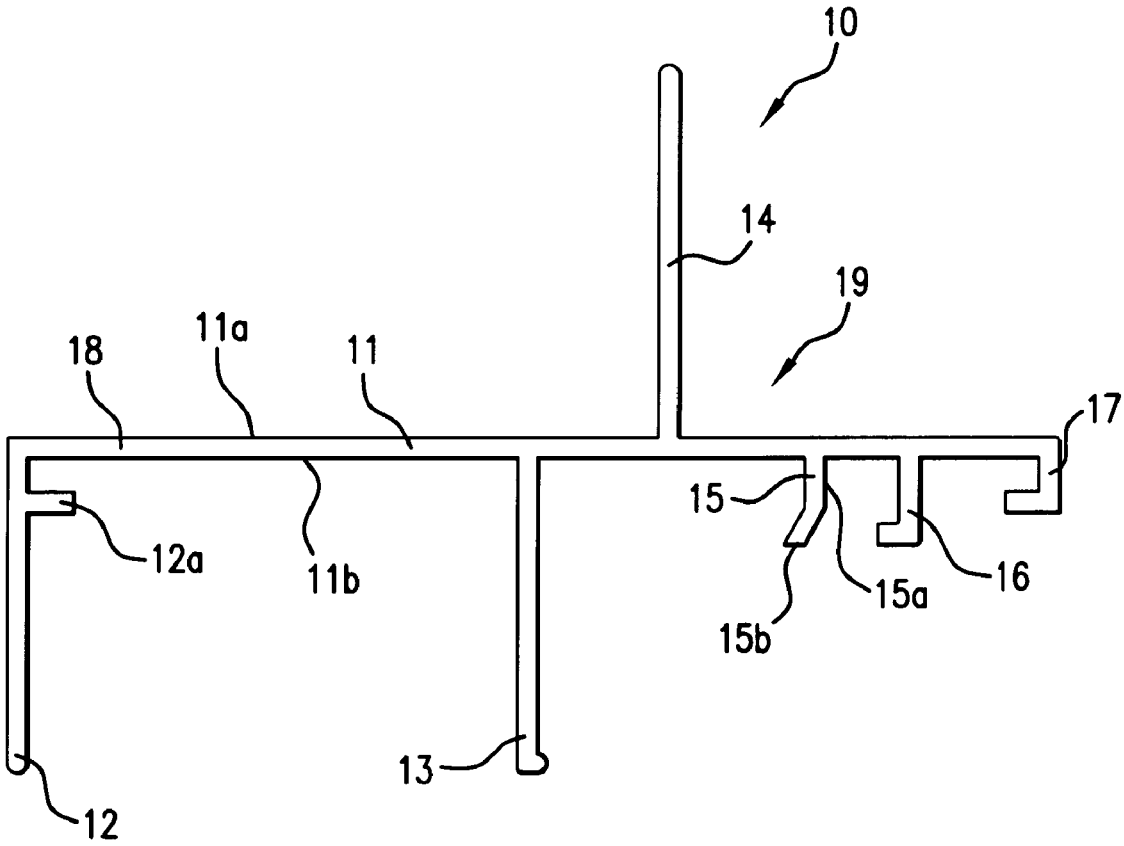
FIG. 9 is a side view of the frame member of FIG. 8.

Referring now to FIG. 9, a side view of the first end 18 of the head 10 is shown. The head 10 comprises a web 11, which is disposed substantially transversely across an entire width of the body 19. The web 11 comprises a first surface 11*a* and a second surface 11*b*. The first surface 11*a* and the second surface 11*b* are substantially planar surfaces and are disposed substantially parallel to one another.

Disposed on one end of the web 11 is a first flange 12. The first flange 12 is disposed substantially perpendicular to the web 11 and is coupled to the second surface 11*b* of the web 11 in a cantilevered manner. The first end receiving channel 83 is adapted to receive the first flange 12. Depending from the first flange 12 is a first flange rib 12*a*. The first flange rib 12*a* is disposed substantially parallel to the web 11. Alternatively, other suitable configurations for the first flange 12 and the first flange rib 12*a* can be used.

Disposed on an end of the web 11 opposite the first flange 12 is an end channel 17. The end channel 17 is substantially L-shaped and depends from the second surface 11*b* of the web 11. An end of the end channel 17 coupled to the web 11 is disposed substantially perpendicular to the web 11, while the other end of the end channel 17 is disposed substantially parallel to the web 11. Alternatively, other suitable configurations for the end channel 17 are possible. The end channel 17 forms a complementary surface with the second abutment 47 of the first leg 40 of the corner key 20.

A medial flange 13 is disposed between the first flange 12 and the end channel 17. The medial flange 13 is coupled to the second surface 11*b* of the web 11. In one embodiment, the medial flange 13 substantially bisects the web 11. The medial flange 13 is substantially perpendicular to the web 11. A length of the medial flange 13 is substantially equal to a length of the first flange 12. Alternatively, the medial flange 13 can be disposed in other suitable arrangements. The medial flange 13 forms a complementary surface with the medial wall 30 of the corner key 20.

Disposed between the medial flange 13 and the end channel 17 is a second flange 14. The second flange 14 is coupled to the first surface 11*a* of the web 11. The second flange 14 is disposed substantially perpendicular to the web 11. The first receiving channel 49 is adapted to receive the second flange 14. A length of the second flange 14 is greater than the length of the first flange 12. Alternatively, the second flange 14 can be disposed in other suitable arrangements.

Disposed between the second flange 14 and the end channel 17 is a first rib 15. The first rib 15 includes a first leg 15*a* and a second leg 15*b*. The first leg 15*a* of the first rib 15 is coupled to the second surface 11*b* of the web 11. The first leg 15*a* is disposed substantially perpendicular to the web 11. The second leg 15*b* is disposed substantially obtuse with respect to the web 11. Alternatively, the first rib 15 can be disposed in other suitable arrangements. The first rib 15 forms a complementary surface for the third abutment 48 of the first leg 40 of the corner key 20.

A second rib 16 is disposed between the first rib 15 and the end channel 17. The second rib 16 includes a first leg 16*a* and a second leg 16*b*. The first leg 16*a* of the second rib 16 is coupled to the second surface 11*b* of the web 11. The first leg 16*a* is disposed substantially perpendicular to the web 11. The second leg 16*b* is disposed substantially parallel to the web 11. Alternatively, the second rib 16 can be disposed in other suitable arrangements. The second rib 16 forms a complementary surface for the second abutment 47 of the first leg 40 of the corner key 20.

As described above, the head 10 is sufficiently rigid such that it is flexurally stable. In other words, the head 10 does not exhibit appreciable deformation when manipulated by hand or under ordinary conditions of manufacture or assembly.

Referring again to FIGS. 7 and 8, coupling the corner key 20 and the head 10 will be described next. In coupling the corner key 20 with the head 10, the plurality of first projections 60 serve to guide the first leg 40 of the corner key 20 into alignment with the first end 18 of the head 10. When aligned, the first projection 61 is disposed between the end channel 17, the second surface 11*b* of the web 11, and the second rib 16. The second projection 62 is disposed between the second rib 16, the second surface 11*b* of the web 11, and the first rib 15. The third projection 63 is disposed between the first rib 15, the second surface 11*b* of the web 11, and the medial flange 13. The fourth projection 64 is disposed between the medial flange 13, the second surface 11*b* of the web 11, and the first flange 12.

The first abutment 46 of the first leg 40 abuts the end channel 17. The second abutment 47 of the first leg 40 abuts the second rib 16. The third abutment 48 of the first leg 40 abuts the first rib 15. The first ridge 33 of the medial wall 30 of the first leg abuts the medial flange 13. The first medial projection 35 of the medial wall 30 is disposed adjacent to the medial flange 13. In one embodiment, the first medial projection 35 is coupled to the medial flange 13. The end receiving channel 83 is adapted to couple with the first flange 12. Alternatively, other suitable configurations can be used.

The first web 11 is coupled to the first receiving groove 45. The second flange 14 is coupled to the first receiving channel 49. The corner key 20 and the head 10 can be coupled to one another using a biasing force of the first prong 61*b* of the first projection 61 and the first prong 64*b* of the fourth projection 64. A width measured from the first prong 61*b* of the first projection to the first prong 64*b* of the fourth projection 64 generally is greater than a width of the web 11 measured from the first flange 12 to the end channel 17. Thus, the first prongs 61*b*,64*b* must be deflected to couple the corner key 20 and the head 10. The first prongs 61*b*,64*b* generally are sufficiently flexible such that they can be deformed sufficiently by hand to couple the corner key 20 and the head 10.

Generally, the biasing force exerted by the first prongs 61*b*,64*b* against the head 10 can be sufficient to maintain the corner key 20 and the head 10 in alignment during injection and curing of the sealant such that securing means external to the corner key 20 and the head 10 are not needed. Other suitable means can be used to maintain the head 10 and the corner key 20 in alignment during injection and curing of the sealant.

In another embodiment, a portion of the head 10 is deformed such that the head 10 and the corner key 20 are coupled together by a friction fit or a mechanical interference. For example, the web 11 can be deformed (e.g., crimped, dimpled, stapled, punched, sheared, etc.) into a surface of the corner key 20, such as for example, the first end receiving channel 83.

The force exerted against the web 11 is sufficient to plastically deform the web 11, however, insufficient to pierce or penetrate the web 11. In one embodiment, the web 11 is deformed prior to injection of the sealant. In another embodiment, the web 11 is deformed after injection of the sealant. In such a configuration, the head 10 and the corner key 20 can be secured together without having created an access point for water to leak into the window assembly 1.

Furthermore, the mechanical interference between the deformed web 11 and the corner key 20 can serve to close a pathway available to the sealant. Thus, the contact between the deformed web 11 and the corner key 20 acts to both physically capture the corner key 20 and the head 10 and to seal the sealant pathway.

As described above, the sealant is injected through the injection port 93 and travels through the first pathway 97 and the second pathway 98. The sealant is allowed to set or cure, which typically takes approximately one to two minutes. The corner key and the head 10 can thus be further manipulated in assembling or manufacturing the window assembly 1.

In an embodiment in which a thermo-reaction sealant is used, a temperature sensor (not shown) is disposed proximate to the first expulsion port 94. As the thermo-reaction sealant fills the first pathway 97, heat escapes through the first expulsion port 94. A predetermined temperature indicates that the thermo-reactant sealant has filled the entire first pathway 97. Generally, such a temperature is approximately 180° F. (82° C.). Thus, a specified amount of thermo-reaction sealant can be disposed in the first pathway 97 without requiring precise measurement prior to dispensing the sealant. In one embodiment, the temperature sensor is coupled to an indicator to provide an visual or audible cues as the predetermined temperature is being approached, has been reached, and/or has been exceeded.

As described above, the corner key 10 and the head 10, when coupled together form an assembly. Generally, four frame members and four corner keys 20 form the window assembly 1 shown in FIG. 1. As described above, the principles of the present invention can be used in a wide variety of alternate assemblies to accommodate different dimensioned assemblies, as well as different designs or configurations. Such alternate assemblies will not be described here.

Figure 10:
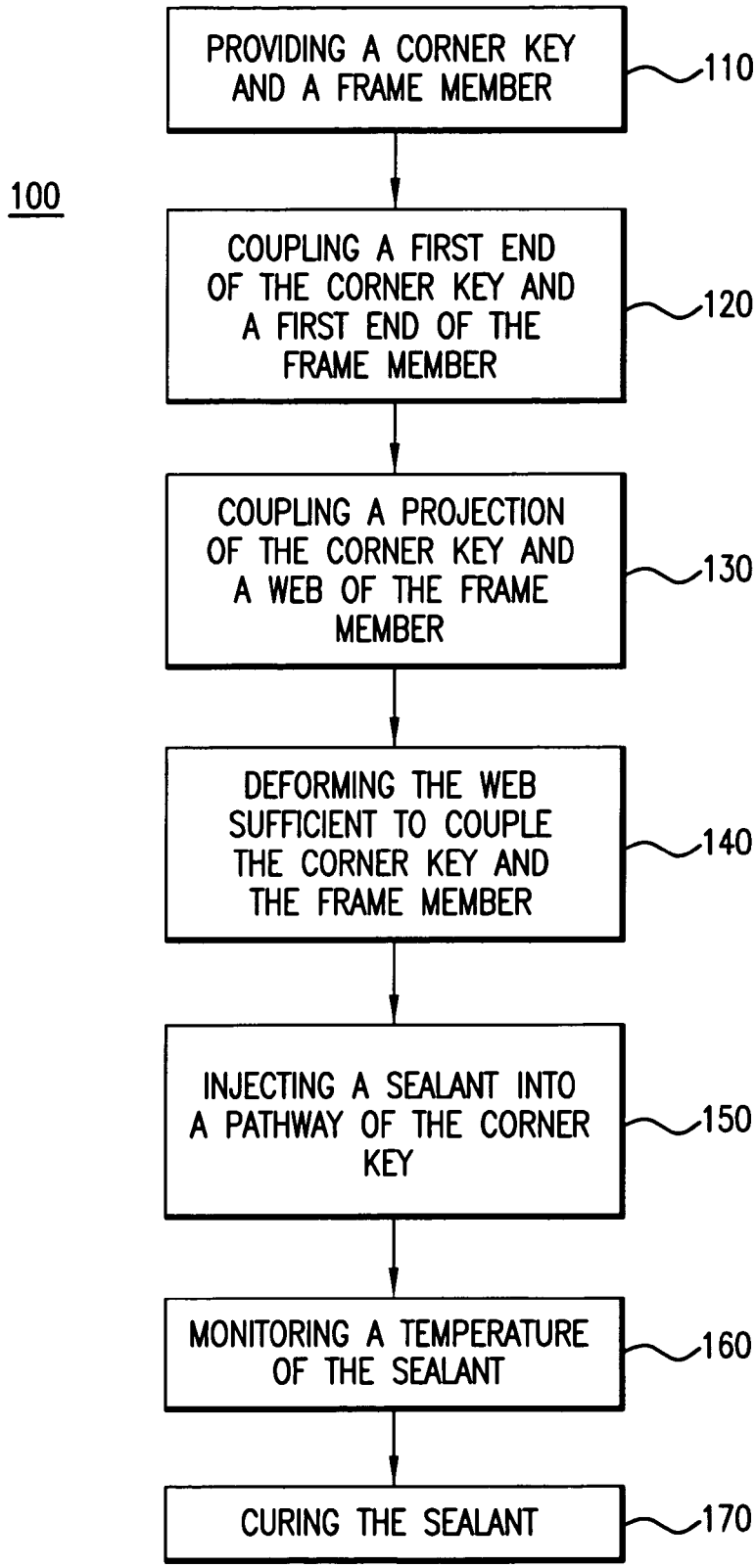
FIG. 10 is a block diagram of a method according to the invention.

Referring now to FIG. 10, a method 100 according to an embodiment of the present invention is shown. FIG. 10 shows an exemplary embodiment of a method of assembling a window assembly. The method 100 may be employed to assemble the window assembly 1 with the corner key 20 and the head 10, as described above. However, the present invention may be employed to make a wide variety of other assemblies. Items shown in FIGS. 1-9 are referred to in describing FIG. 10 to aid understanding of the embodiment of the method 100 shown.

As indicated by block 110, a corner key and a frame member are provided. The corner key can be as that described above with reference to FIGS. 1-7. Alternatively, other suitable embodiments can be used for the corner key. The corner key is generally comprised of a polycarbon material, such as that described above, and is formed in a multi-die injection process.

In one embodiment, the corner key comprises a first end, a second end opposite the first end, a projection, and a pathway disposed in the corner key. In one embodiment, the corner key comprises a first leg and a second leg. The first leg is disposed between the first and second ends, and comprises a first surface and a second surface. Typically, the first and second surfaces are generally planar and are disposed substantially parallel to one another.

The second leg of the corner key is disposed between the first and second ends and substantially perpendicular to the first leg. Typically, the second leg comprises a first surface and a second surface. The first and second surfaces are generally planar and are disposed substantially parallel to one another. In one embodiment, the first surface of the first leg is disposed adjacent to the first surface of the second leg and the second surface of the first leg is adjacent to the second surface of the second leg. Alternatively, other suitable configurations can be used.

A first receiving groove is typically disposed in the first leg. The first receiving groove typically extends along an entire length of the first leg. The first receiving groove is adapted to receive a portion of the frame member. Typically, a first projection extends from the first leg and is disposed proximate to the first receiving groove.

In one embodiment, a first expulsion port is in communication with the first receiving groove. The first expulsion port is disposed in the first surface of the first leg. The first expulsion port is adapted to permit a fluid or a gas to escape or vent from the first receiving groove.

A second receiving groove is generally disposed in the second leg. The second receiving groove typically extends along an entire length of the second leg. The second receiving groove is adapted to receive a portion of another frame member. Alternatively, other suitable configurations of the second receiving groove are possible. Typically, a second projection extends from the second leg and is disposed proximate to the second receiving groove.

In one embodiment, a second expulsion port is in communication with the second receiving groove. The second expulsion port is disposed in the first surface of the first leg. The second expulsion port is adapted to permit a fluid or a gas to escape or vent from the second receiving groove. In one embodiment, a pathway comprises the first and second receiving grooves. In another embodiment, the pathway comprises the first and second receiving grooves and the first and second expulsion ports.

In one embodiment, an injection port is in communication with the first and second receiving grooves. Alternatively, the injection port is coupled to either the first channel or the second channel. The injection port is typically disposed at an intersection of the second surface of the first leg and the second surface of the second leg. The injection port is generally circular in shape and is circumscribed by the first and second channels.

The injection port and the receiving grooves are adapted to receive and communicate a fluid, such as a sealant. Suitable sealants include, silicone-based or urethane-based compounds. In one embodiment, the sealant is a thermo-reaction silicone. Alternatively, other suitable sealants can be used.

A first receiving channel is generally coupled to and in communication with the first receiving groove. The first receiving channel is disposed substantially perpendicular to the first receiving groove. A second receiving channel is generally coupled to and in communication with the second receiving groove. The second receiving channel is disposed substantially perpendicular to the second receiving groove.

The frame member comprises a first end, a second end, and a web. The frame member can be a head, a side jamb, or another suitable frame member. As described above, the frame member is typically comprised of an extruded aluminum. The web is generally disposed transversely across an entire width of the frame member. The web comprises a first surface and a second surface. The first and second surfaces of the web are substantially planar surfaces and are disposed substantially parallel to one another.

The first frame member can be as that described above with reference to FIGS. 1 and 8-9. Alternatively, other suitable embodiments can be used for the frame member. In one embodiment, the first end of the frame member comprises a first flange coupled to the web, a first rib, and an end channel. The first rib and the end channel depend from the web.

Typically, a second flange and a third flange are also coupled to the web. The third flange is disposed opposite the second flange. A first flange rib depends from the first flange. A second rib depends from the web. A plurality of slots are formed by the web, the first and second flanges, the first flange rib, the first and second ribs, and the end channel. The plurality of slots are adapted to receive the first projection.

As indicated by block 120, the method 100 comprises coupling the first end of the corner key and the first end of the frame member. Generally, coupling the first end of the corner key and the first end of the frame member is achieved by placing the first ends of the corner key and the frame member proximate to one another, aligning the projection of the corner key and the slots of the frame member and engaging the first ends of the corner key and the first end of the frame member together until the ends are in an abutting arrangement.

As indicated by block 130, the method 100 comprises coupling the projection of the corner key and the web of the frame member. In an embodiment, the projection comprises a biasing member adapted to exert a biasing force against the web of the frame member. In one embodiment, coupling the projection of the corner key and the web of the frame member comprises exerting a force against the biasing member and inserting the projection into the web. In one embodiment, the biasing force is sufficient to maintain the web and the corner key in alignment during injection and curing of the sealant (as will be described below). Thus, no external securing means are necessary to maintain the desired alignment of the corner key and the frame. Alternatively, external securing means, such as a clamp or other compression member or device, can be used.

As indicated by block 140, the method 100 comprises deforming the web sufficient to couple the corner key and the frame member. The corner key and the frame member can be coupled before injecting sealant into the corner key. Alternatively, the corner key and the frame member can be coupled after injecting sealant into the corner key. In one embodiment, the corner key and the frame member are coupled by a friction fit. In another embodiment, the corner key and the frame member are coupled by a mechanical interference. Thus, no external securing means are necessary to secure together or maintain the desired alignment of the corner key and the frame.

As described above and with reference to FIGS. 7-8, the web is physically deformed, typically by an externally applied force, causing a portion of the web to undergo plastic deformation. The web may be deformed by a variety of processes, including, but not limited to, crimping, dimpling, stapling, punching, and shearing. For example, a saber-tooth punch may be used to deform the web. The applied force is sufficient to plastically deform the web and to couple the web and the projection together. The force applied to the web, however, is insufficient to pierce the web. Thus, water-tight integrity is maintained.

As indicated by block 150 the method 10 includes injecting a sealant into the pathway of the corner key. As described above, the sealant typically includes silicone-based or urethane-based compounds. In one embodiment, the sealant includes a thermo-reaction silicone. In another embodiment, the sealant can be a structural sealant, which may provide the window assembly with enhanced structural integrity. Alternatively, other suitable sealants can be used.

Generally, the sealant is injected into the pathway through the injection port. In one embodiment, approximately 0.528 cubic inches (8.652 cubic centimeters) of the sealant is injected into the pathway under a pressure of approximately 2500 pounds per square inch (17.24 MPa). In an embodiment, the sealant is injected in approximately two seconds. Other suitable injection pressures and times and sealant volumes can be used.

As indicated by block 160, the method 100 comprises monitoring a temperature of the sealant. As described above, the thermo-reaction silicone generates heat. As this sealant fills the pathway, a temperature gage disposed proximate to the first and second expulsion ports detects heat produced by the sealant, indicating that the pathway has been filled with a predetermined amount of sealant. The heat generated by the sealant—approximately 180° F. (82° C.)—is much greater than normal room temperature. An operator or a device monitoring the temperature gage can thus determine when the pathway has been filled with an appropriate amount of sealant.

In an alternate embodiment, the temperature gage is coupled to an indicator providing audible or visual signals indicating that the pathway is close to being filled, is full, and/or has been over-filled. In another alternate embodiment, the temperature gage is coupled to a processor of an automated control system. Such a temperature gage is operable to communicate input signals to the processor such that the control system is operable to regulate an amount of sealant injected into the injection port.

As indicated by block 170, the method 100 comprises curing the sealant. Generally, curing the sealant comprises leaving the sealant undisturbed to permit the sealant to form an adhesive bond with the surfaces with which the sealant is in contact. In one embodiment, the sealant cures in approximately one to two minutes. After the sealant has cured, the window assembly can be further manipulated, as desired.

The method 10 can be performed manually or by use of automation. Where the method 100 is automated, or partially automated, a device (not shown) may clamp the frame member and corner key substantially square and generally firm while injecting the sealant material. A dwell time while the assembly is clamped permits an initial set time of the sealant material.

Referring now to FIGS. 11-17, an alternate embodiment of a corner key 220 according to the present invention is shown. The corner key 220 can be used in the assembly 1, as described above and as shown in FIG. 1. Thus, the corner key 220 can be used with the frame members, i.e., side jambs 3 and head 10. Alternatively, corner key 220 can be used in other suitable assemblies.

The corner key 220 is formed of materials similar to that described above with reference to the first embodiment of the corner key 20. The corner key 20 is also generally formed by a multi-die injection process. Alternatively, other suitable materials and forming methods can be used for the corner key 220.

Referring now to FIGS. 11-14, perspective views of the corner key 220 according to another embodiment of the present invention are shown. The corner key 220 described below can be modified in accordance with the principles of the present invention for use with a wide variety of window or door frame assemblies, in addition to that described herein. Furthermore, the corner key 220 can be modified to accommodate different positions of the corner key 220 with respect to a window assembly, such as, for example, disposing the corner key 220 on an inside or an outside of the window assembly 1. Accordingly, an exemplary embodiment of the corner key 220 will be described below.

The corner key 220 comprises a first end 221 and a second end 222. The second end 222 is disposed opposite the first end 221. Disposed between the first end 221 and the second end 222 is a first leg 240 and a second leg 250. The second leg 250 is disposed substantially perpendicular to the first leg 240. Alternatively, the second leg 250 is disposed in other suitable positions with respect to the first leg 240.

The first leg 240 comprises a first surface 241 and a second surface 242. Typically, the first surface 241 and the second surface 242 are generally planar and are substantially parallel to one another. In one embodiment, a first edge 243 is disposed between and couples the first surface 241 and the second surface 242 proximate to the first end 221. The first edge 243 is generally perpendicular to the first surface 241 and the second surface 242.

A second edge 244 generally is disposed between and couples the first surface 241 and the second surface 242 at the second end 222. The second edge 244 is generally perpendicular to the first surface 241 and the second surface 242. The first edge 243 and the second edge 244 are generally parallel to one another.

The second leg 250 comprises a first surface 251 and a second surface 252. Typically, the first surface 251 and the second surface 252 are generally planar and are substantially parallel to one another. In one embodiment, a first edge 253 is disposed between and couples the first surface 251 and the second surface 252 proximate to the first end 221. The first edge 253 is generally perpendicular to the first surface 251 and the second surface 252.

In an embodiment, the first leg 240 and the second leg 250 are coupled together. In one embodiment, the first surface 241 of the first leg 240 is disposed adjacent to the first surface 251 of the second leg 250 and the second surface 242 of the first leg 240 is disposed adjacent to the second surface 252 of the second leg 250.

A second edge 254 generally is disposed between and couples the first surface 251 and the second surface 252 proximate to the second end 222. The second edge 254 is generally perpendicular to the first surface 251 and the second surface 252. The first edge 253 and the second edge 254 are generally parallel to one another. In one embodiment, the corner key 220 is substantially solid. In another embodiment, the corner key 220 is substantially hollow.

In one embodiment, an end wall 280 is disposed substantially coplanar with the second end 222. Generally, the end wall 280 comprises a first surface 281 and a second surface 282. The first surface 281 and the second surface 282 are generally planar surfaces and are substantially parallel to one another. The first surface 281 of the end wall 280 typically is coupled to and extends perpendicularly from the first surface 241 of the first leg 240 and the first surface 251 of the second leg 250. The first surface 281 of the end wall 280 typically faces the first end 221.

The second surface 282 of the end wall 280 typically is coupled to and extends from the second edge 244 of the first leg 240 and the second edge 254 of the second leg 250. Generally, the second surface 282 of the end wall 280 is substantially coplanar with both the second edge 244 of the first leg 240 and the second edge 254 of the second leg 250.

In one embodiment, a first end projection 285 and a second end projection 286 of the first surface 281 extend beyond the second surface 282 thereby forming a first ridge 283 and a second ridge 284. As will be described in more detail below, the first ridge 283 is adapted to couple with a portion of a frame member. The second ridge 284 is adapted to couple with another portion of a frame member. The first ridge 283 is disposed substantially perpendicular to the first leg 240 and the second ridge 284 is disposed substantially perpendicular to the second leg 250. Alternatively, other suitable arrangements are possible.

In one embodiment, a medial wall 230 is disposed between the first end 221 and the second end 222. Typically, the medial wall 30 is disposed substantially parallel to the end wall 280. Generally, the medial wall 230 comprises a first surface 231 and a second surface 232. The first surface 231 and the second surface 232 are generally planar surfaces and are substantially parallel to one another. The first surface 231 of the medial wall 230 typically is coupled to and extends perpendicularly from the first surface 241 of the first leg 240 and the first surface 251 of the second leg 250. The first surface 231 of the medial wall 230 typically faces the first end 221.

The second surface 232 of the medial wall 230 typically is coupled to and extends perpendicularly from the first surface 241 of the first leg 240 and the first surface 251 of the second leg 250. Generally, the second surface 232 of the medial wall 230 faces the first surface 281 of the end wall 280.

In one embodiment, a first medial projection 235 and a second medial projection 236 extend beyond the second surface 232 thereby forming a first ridge 233 and a second ridge 234. The first medial projection 235 generally includes a first edge 235*a* and a second edge 235*b*. Typically the first edge 235*a* and the second edge 235*b* are disposed substantially perpendicular to one another. Likewise, the second medial projection 236 generally includes a first edge 236*a* and a second edge 236*b*. Typically the first edge 236*a* and the second edge 236*b* are disposed substantially perpendicular to one another.

Generally, the first edge 235*a* of the first medial projection 235 is substantially coplanar with the first edge 285*a* of the first end projection 285 and the second edge 235*b* of the first medial projection 235 is substantially coplanar with the second edge 285*b* of the first end projection 285. Similarly, the first edge 236*a* of the second medial projection 236 is substantially coplanar with the first edge 286*a* of the first end projection 286 and the second edge 236*b* of the second medial projection 236 is substantially coplanar with the second edge 286*b* of the second end projection 286.

As will be described in more detail below, the first ridge 233 is adapted to couple a portion of a frame member. The second ridge 234 is adapted to couple with another portion of a frame member. The first medial projection 235 is disposed substantially perpendicular to the first leg 240 and the second medial projection 236 is disposed substantially perpendicular to the second leg 250. Generally, the first medial projection 235 is substantially coplanar with the first end projection 285 and the second medial projection 236 is substantially coplanar with the second end projection 286. Alternatively, other suitable arrangements are possible.

A first channel 291 is disposed in the first surface 241 of the first leg 240. In one embodiment, the first channel 291 is disposed proximate to the second end 222. In other words, the first channel 291 is disposed closer to the second end 222 than the first end 221. Alternatively, the first channel 291 is disposed in other suitable positions. The first channel 291 is adapted to receive and communicate a fluid, such as a sealant. Suitable sealants include those discussed above.

A second channel 292 is disposed in the first surface 252 of the second leg 250. The second channel 292 is adapted to receive and communicate a fluid and is in communication with the first channel 291. Generally, the second channel 292 is disposed proximate to the second end 222 and opposite the first channel 291. Alternatively, the second channel 292 is disposed in other suitable positions.

In one embodiment, an injection port 293 is coupled to the first channel 291 and the second channel 292. Generally, the injection port 293 is in communication with the first channel 291 and the second channel 292. Alternatively, the injection port 293 can be coupled to either the first channel 291 or the second channel 292. The injection port 293 is generally coupled proximate to a spine 296. The spine 296 comprises a surface or an edge formed by a junction of the second surface 242 of the first leg 240 and the second surface 252 of the second leg 250. The injection port 293 is generally circular in shape and is circumscribed by the first channel 291 and the second channel 292. Alternatively, other suitable shapes and configurations can be used.

Figure 14:
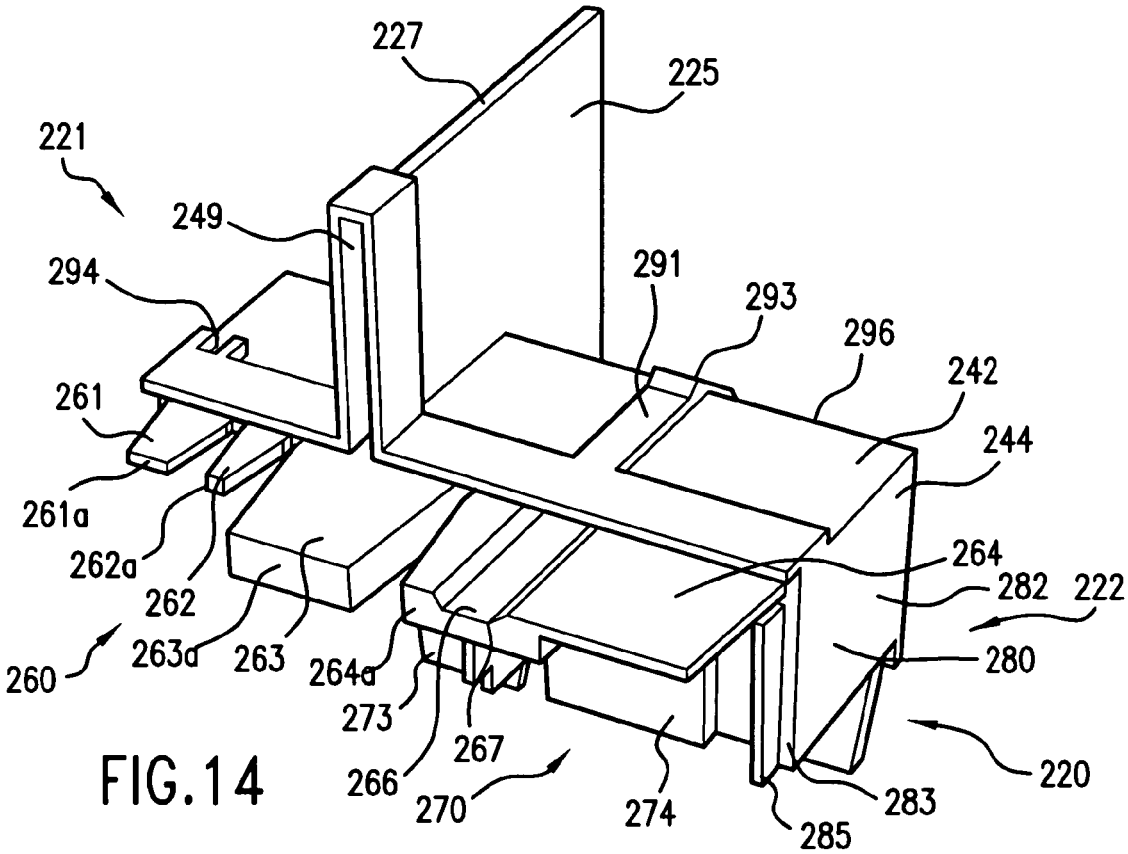
FIG. 14 is yet another perspective view of the corner key of FIG. 11.

A first receiving groove 245 is disposed in the first leg 240 and is in communication with the first channel 291. As best shown in FIG. 14, the first receiving groove 245 typically extends along an entire length of the first leg 240 from the first edge 243 to the second edge 244. As will be described in more detail below, the first receiving groove 245 is adapted to receive a portion of a frame member of the window assembly 1. Alternatively, other suitable configurations of the second receiving groove 255 are possible. In one embodiment, the first receiving groove 245 and the first channel 291 are coplanar and perpendicular to one another.

Figure 12:
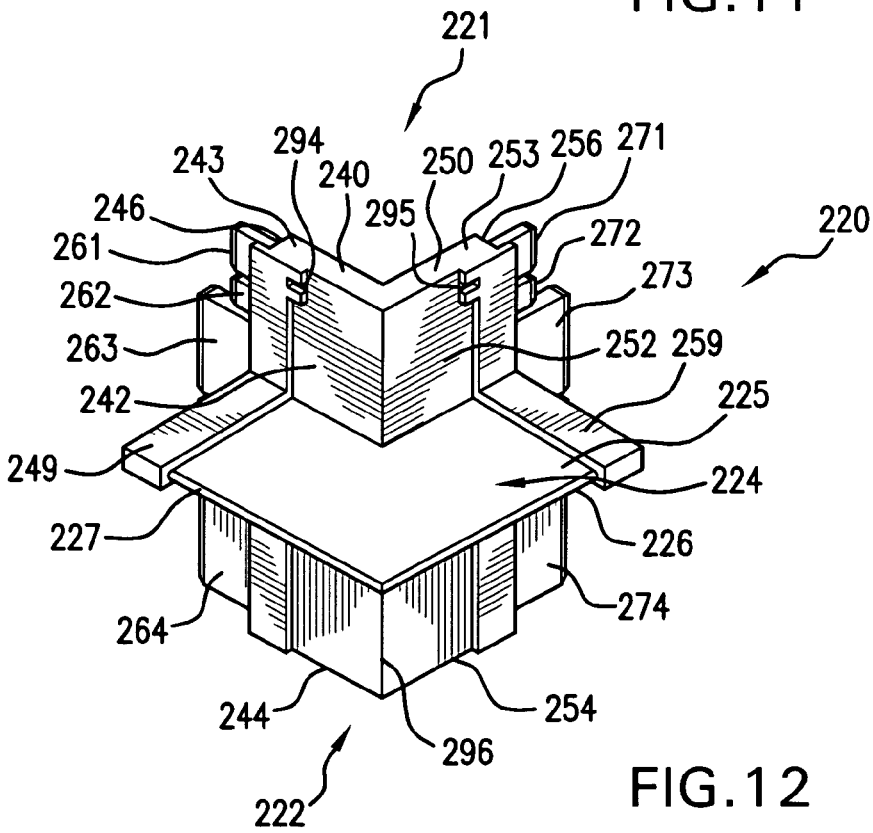
FIG. 12 is another perspective view of the corner key of FIG. 11.
Figure 13:
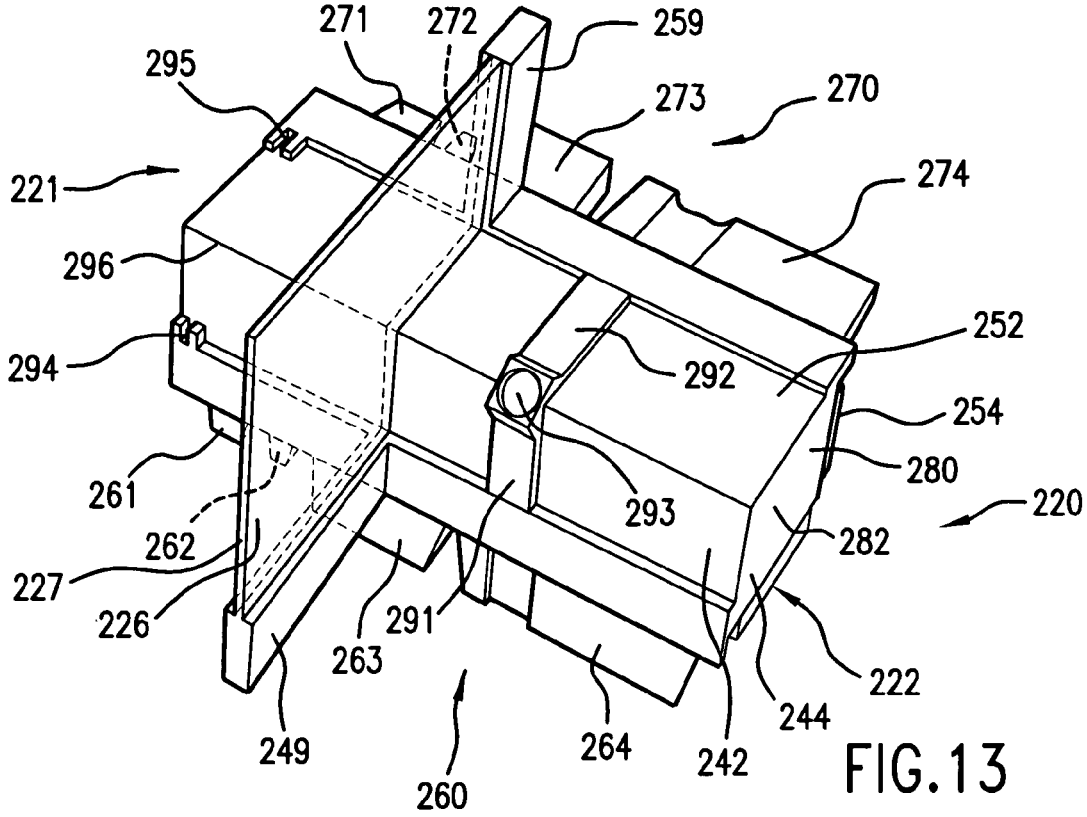
FIG. 13 is still another perspective view of the corner key of FIG. 11.

As best seen in FIGS. 12 and 13, a first expulsion port 294 is coupled to and is in communication with the first receiving groove 245. The first expulsion port 294 is disposed in the first surface 242 of the first leg 240. The first expulsion port 294 is adapted to permit a fluid or a gas to escape or vent from the first receiving groove 245.

A second receiving groove 255 is disposed in the second leg 250 and is in communication with the second channel 292. The second receiving groove 255 typically extends along an entire length of the second leg 250 from the first edge 253 the second edge 254. The second receiving groove 255 is adapted to receive a portion of another frame member of the window assembly 1. Alternatively, other suitable configurations of the second receiving groove 255 are possible. In one embodiment, the second receiving groove 255 and the second channel 292 are coplanar and perpendicular to one another.

As best seen in FIGS. 12 and 13, a second expulsion port 295 is coupled to and is in communication with the second receiving groove 255. The second expulsion port 295 is disposed in the first surface 252 of the first leg 250. The second expulsion port 295 is adapted to permit a fluid or a gas to escape or vent from the second receiving groove 255. Thus, the first receiving groove 245, the second receiving groove 255, the first channel 291, and the second channel 292 are all in communication and form a pathway.

In one embodiment, a first receiving channel 249 is coupled to and in communication with the first receiving groove 245. Generally, the first receiving channel 249 is disposed substantially perpendicular to the first receiving groove 245. Typically, the first receiving channel 249 is disposed substantially perpendicular to the first surface 242 of the first leg 240. The first receiving channel 249 is typically disposed between the injection port 293 and the first expulsion port 294.

In one embodiment, a second receiving channel 259 is coupled to and in communication with the second receiving groove 255. Generally, the second receiving channel 259 is disposed substantially perpendicular to the second receiving groove 255. The second receiving channel 259 is adapted to receive a portion of a frame member of the window assembly 1. The second receiving channel 259 is disposed opposite the first receiving channel 249. Typically, the second receiving channel 259 is disposed substantially perpendicular to the first surface 252 of the second leg 250. The second receiving channel 259 is typically disposed between the injection port 293 and the second expulsion port 295.

In one embodiment, a fin 224 is coupled to the second surface 242 of the first leg 240 and the second surface 252 of the second leg 250. The fin 224 is adapted to provide a surface with which to couple the window assembly 1 to a building structure. For example, the window assembly 1, can be secured to a wall or underlying structural support by using one or more fasteners, such as a nail or a screw.

Generally, the fin 224 is disposed between the first receiving channel 249 and the second receiving channel 259. The fin 224 includes a first surface 225 and a second surface 227. The first surface 225 and the second surface 227 are generally planar and substantially parallel to one another. An edge 226 defines a perimeter of the fin 224 and couples the first surface 225 and the second surface 227. Alternatively, other suitable configurations are possible.

In one embodiment, the corner key 220 further comprises a first projection extending from the first leg 240 and a second projection extending from the second leg 250. Typically, the first projection comprises a plurality of first projections 260 and the second projection comprises a plurality of second projections 270. As shown in FIGS. 11-14, the plurality of first projections 260 comprises a first projection 261, a second projection 262, a third projection 263, and a fourth projection 264.

The plurality of first projections 260 generally are coupled to the second surface 242 of the first leg 240, and generally are disposed proximate to the first receiving groove 245. The plurality of first projections 260 extend substantially along an entire length of the first receiving groove 245. As will be described in more detail below, the plurality of first projections 260 are adapted to couple with a frame member of the window assembly 1.

The first projection 261 is disposed proximate to the first edge 243 of the first leg 240. The first projection 261 gradually tapers to a flat face 261*a*. Alternatively, other suitable configurations for the first projection 261 can be used. Surrounding the first projection 261 is a first abutment 246 and a second abutment 247. The first abutment 246 is disposed proximate to the first edge 243 of the first leg 240.

The second projection 262 is disposed between the first projection 261 and the third projection 263. The second projection 262 extends to substantially the same length as the first projection 261 and also gradually tapers to a flat face 262*a*. Alternatively, other suitable configurations for the second projection 262 can be used. Surrounding the second projection 262 is the second abutment 247 and a third abutment 248.

The third projection 263 is disposed between the second projection 262 and the fourth projection 264. The third projection 263 extends beyond the length of the first projection 261 and the second projection 262. The third projection 263 gradually tapers to a flat face 263*a*. Alternatively, other suitable configurations for the third projection 263 can be used. Surrounding the third projection 263 is the third abutment 248 and the first surface 231 of the medial wall 230.

The fourth projection 264 is disposed between the third projection 263 and the second edge 244 of the first leg 240. The fourth projection 264 extends to substantially the same length as the third projection 263 and also gradually tapers to a flat face 264*a*. Alternatively, other suitable configurations for the fourth projection 264 can be used. Surrounding the fourth projection 263 is the second surface 232 of the medial wall 230 and the first surface 281 of the end wall 280.

On a face of the fourth projection 264 facing the second surface 242 of the first leg 240 is a projection channel 265. The projection channel 265 extends along the length of the fourth projection 264 and is in communication with the first channel 291. On a face of the fourth projection 264 facing the first surface 241 of the first leg 240 is a recess 266 and a projection ridge 267. The recess 266 is disposed opposite the projection channel 265 and proximate to the face 264*a*. The recess 266 is substantially circular in shape. The projection ridge 267 divides the fourth projection 264 into two substantially equal portions. The portion of the fourth projection 264 proximate the second edge 244 of the first leg 240 is approximately the same thickness as the first projection 261 and the second projection 262. The other portion of the fourth projection 264 is approximately the same thickness as the third projection 263.

The plurality of second projections 270 generally are coupled to the second surface 252 of the second leg 250 and generally are disposed proximate to the first receiving groove 255. The plurality of second projections 270 extend substantially along an entire length of the first receiving groove 255. The plurality of second projections 270 are adapted to couple with a frame member of a window assembly 1. As the plurality of second projections 270 are similar in configuration and arrangement as the plurality of first projections 260, the plurality of second projections 270 will not be described in further detail.

Figure 11:
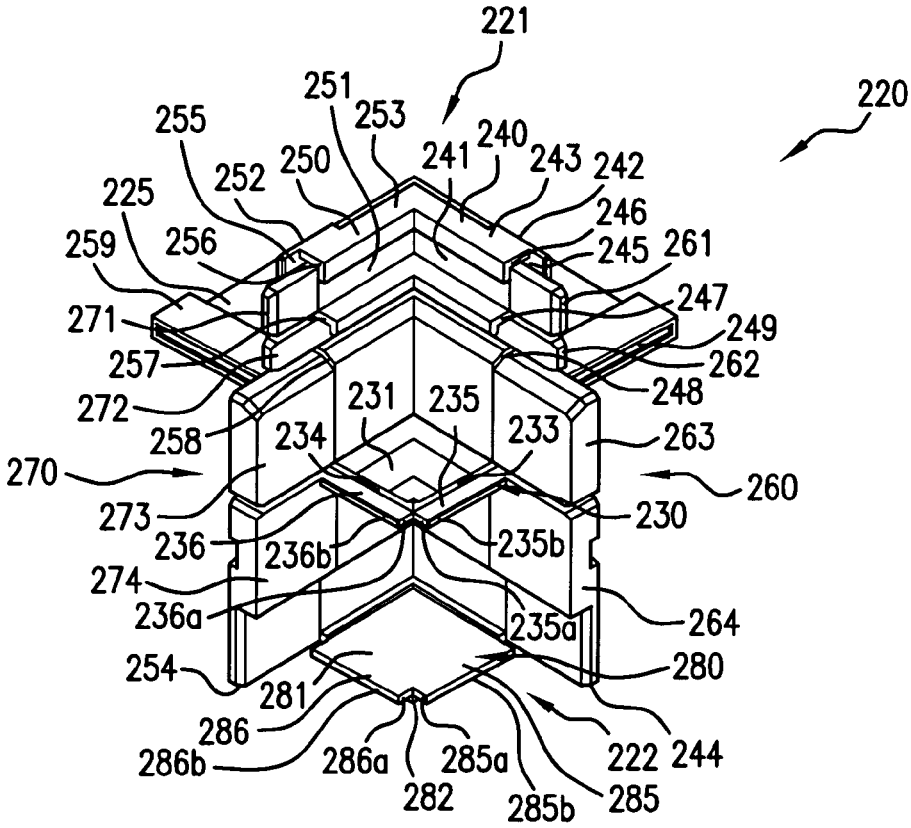
FIG. 11 is a perspective view of a corner key according to another embodiment of the present invention.

Referring now to FIGS. 15 and 16, a first pathway 297 and portions of a second pathway 298 are shown. FIG. 15 is a side view of the corner key 220 of FIG. 11 and FIG. 16 is a bottom view of the corner key of FIG. 11. The cross-hatching in FIGS. 15 and 16 illustrates the first pathway 297 and the second pathway 298.

The first pathway 297 is disposed in the first leg 240 and is defined by the first receiving groove 245, the first channel 291, the injection port 293, and the first expulsion port 294. The second pathway 298 disposed in the second leg 250 is defined by the second receiving groove 255, the second channel 292, the injection port 293, and the second expulsion port 295. The second pathway 298 disposed in the second leg 250 will not be described in detail here, as it is similar to the first pathway 297 disposed in the first leg 240.

As described above, the first pathway 297 is adapted to receive and communicate a sealant (not shown). Generally, the sealant is a silicone-based compound or a urethane-based compound. Typically, the sealant is a structural sealant, such that the corner key 220 provides structural integrity to the corners of the window assembly 1. Other suitable sealants can be used.

In one embodiment, the sealant is a thermo-reaction urethane compound that is heated (before being injected) between approximately 230° F. (110° C.) and 265° F. (129° C.). In one embodiment, the sealant is heated to approximately 250° F. (121° C.).

Typically, the sealant is injected into the first pathway 297 through the injection port 293. As the injection port 293 is in communication with both the first channel 291 and the second channel 292, the injected sealant is uniformly distributed through both the first leg 240 and the second leg 250.

As the sealant fills the first pathway 297, excess sealant escapes through the first expulsion port 294. The first expulsion port 294 is also adapted to vent gases, generally from the sealant. Typically, cured or hardened sealant in the first pathway 297 prevents egress of the sealant from the first pathway 297 through either the injection port 293 or the first expulsion port 294. Alternatively, the first pathway 297 can be sealed or closed by other suitable means, such as, for example, mechanically attaching or adhering a cap or cover to either or both the injection port 293 and the first expulsion port 294.

As will be described in more detail below, the sealant couples the corner key 220 with a frame member, such as the head 10 (shown in FIG. 17). In one embodiment, the sealant adheres to both the corner key 220 and the head 10, thereby forming an adhesive bond between the corner key 220 and the head 10. In another embodiment, a portion of the frame member is deformed such that the corner key 220 and frame member 10 are mechanically coupled. Alternatively, the corner key 220 and the head 10 can be coupled by any other suitable means.

Referring now to FIG. 17, a bottom view of the head 10 is shown. As described above, the head 10 is adapted to couple with the corner key 220. The head 10 includes a first end 18 and a second end (not shown). A body 19 joins the first end 18 and the second end. As described above, the head 10 typically is made of an extruded aluminum. The other frame members of the window assembly 1, such as the side jamb and meeting rail, typically are also made of extruded aluminum. The first end 18 is disposed proximate to the first leg 240 of the corner key 220. Alternatively, other suitable configurations and materials can be used.

Referring now to FIG. 9, a side view of the first end 18 of the head 10 is shown. As the head 10 is described in detail above, further description will not be repeated here. As described above, the head 10 is sufficiently rigid such that it is flexurally stable. In other words, the head 10 does not exhibit appreciable deformation when manipulated by hand under ordinary conditions of manufacture or assembly.

The first flange 12 forms a complementary surface with the first ridge 283 of the end wall 280 of the corner key 220. The end channel 17 forms a complementary surface with the second abutment 247 of the first leg 240 of the corner key 220. The medial flange 213 forms a complementary surface with the first ridge 233 of the medial wall 230 of the corner key 220. The first rib 215 forms a complementary surface for the third abutment 248 of the first leg 240 of the corner key 220. The second rib 216 forms a complementary surface for the second abutment 247 of the first leg 240 of the corner key 220.

Referring again to FIGS. 16 and 17, coupling the corner key 220 and the head 10 will be described next. In coupling the corner key 220 with the head 10, the plurality of first projections 260 serve to guide the first leg 240 of the corner key 220 into proper alignment with the first end 18 of the head 10. When properly aligned, the first projection 261 is disposed between the end channel 17, the second surface 11*b* of the web 11 and the second rib 16.

The second projection 262 is disposed between the second rib 16, the second surface 11*b* of the web 11, and the first rib 15. The third projection 263 is disposed between the first rib 15, the second surface 11*b* of the web 11, and the medial flange 13. The fourth projection 264 is disposed between the medial flange 13, the second surface 11*b* of the web 11, and the first flange 12.

The first abutment 246 of the first leg 240 abuts the end channel 17. The second abutment 247 of the first leg 240 abuts the second rib 16. The third abutment 248 of the first leg 240 abuts the first rib 15. The first ridge 233 of the medial wall 230 of the first leg 240 abuts the medial flange 13. The first medial projection 235 of the medial wall 230 is disposed adjacent to the medial flange 13. In one embodiment, the first medial projection 235 is coupled to the medial flange 13. The first ridge 283 of the end wall 280 of the first leg 240 abuts the first flange 12. The first end projection 285 of the end wall 280 is disposed adjacent to the first flange 12. In one embodiment, the first end projection 285 is coupled to the first flange 12. Alternatively, other suitable configurations can be used.

The first web 11 is coupled to the first receiving groove 245. The second flange 14 is coupled to the first receiving channel 249. With the corner key 220 and the head 10 thus configured, the corner key 220 and the head 10 are maintained in alignment during injection and curing of the sealant.

In one embodiment, the corner key 220 and the head 10 are coupled to one another by deforming the web 11 such that the second surface 11*b* of the web 11 is coupled with the projection ridge 267. In one embodiment, the web 11 is deformed prior to injection of the sealant. In another embodiment, the web is deformed after injection of the sealant.

Generally, friction between or a mechanical interference formed by the second surface 11*b* of the web 11 and the projection ridge 267 is sufficient to couple the corner key 220 and the head 10 such that external securing means are not needed. Thus, the web 11 is deformed rather than being pierced or staked in place. In such a configuration, the head 10 and the corner key 220 can be coupled together without having created an access point for water to leak into the window assembly 1.

Furthermore, the mechanical interference between the deformed web 11 and the projection ridge 267 can serve to close the first pathway 297 available to the sealant. Thus, the contact between the deformed web 11 and the projection ridge acts to both physically capture the corner key 220 and the head 10 and to seal the first pathway 297.

As described above, the sealant is injected through the injection port 293 and travels through the first pathway 297 and the second pathway 298. The sealant is allowed to set or cure, which typically takes approximately one to two minutes. The corner key and the head 10 can thus be further manipulated in assembling or manufacturing the window assembly 1.

In an embodiment in which a thermo-reaction sealant is used, a temperature sensor (not shown) is disposed proximate to the first expulsion port 294. As the thermo-reaction sealant fills the first pathway 297, heat escapes through the first expulsion port 294. A predetermined temperature indicates that the thermo-reactant sealant has filled the entire first pathway 297. Generally, such a temperature is approximately 180° F. (82° C.).

Thus, a specified amount of thermo-reaction sealant can be disposed in the first pathway 297 without requiring precise measurement of the sealant volume prior to dispensing the sealant. In one embodiment, the temperature sensor is coupled to an indicator to provide visual or audible cues as the predetermined temperature is being approached, has been reached, and/or has been exceeded.

As described above, the corner key 220 and the head 10, when coupled together form an assembly. Generally, four frame members and four corner keys 220 form the window assembly 1 shown in FIG. 1.

While the present invention has been disclosed with reference to certain embodiments, numerous modifications, alterations, and changes to the described embodiments are possible without departing from the sphere and scope of the present invention, as defined by the appended claims. Accordingly, it is intended that the present invention not be limited to the described embodiments, but that it has the full scope defined by the language of the following claims, and equivalents thereof.

What is claimed is:

1. An apparatus adapted to connect a first frame member to a second frame member and to be fixed to a structural support, comprising:

a first end;

a second end opposite the first end;

a first leg disposed between the first and second ends, the first leg being adapted to receive a portion of the first frame member;

a second leg disposed between the first and second ends, the second leg being adapted to receive a portion of the second frame member;

a first receiving groove disposed in the first leg and forming a first pathway;

a first receiving channel disposed in the first leg and in communication with the first receiving groove;

a second receiving groove disposed in the second leg and forming a second pathway;

a second receiving channel disposed in the second leg and in communication with the second receiving groove; and a nailing fin coupled to the first and second legs, wherein the nailing fin is adapted to be positioned adjacent the structural support and secured thereto with a fastener received through the nailing fin.

2. The apparatus of claim 1, wherein the first leg comprises a first surface and a second surface and the second leg comprises a first surface and a second surface, the second leg disposed substantially perpendicular to the first leg, and wherein the first surface of the first leg is disposed adjacent to the first surface of the second leg and the second surface of the first leg is disposed adjacent to the second surface of the second leg.

3. The apparatus of claim 2, further comprising an end wall substantially coplanar with the second end, the end wall coupled to the first surface of the first leg and the first surface of the second leg.

4. The apparatus of claim 3, wherein the end wall comprises a first surface and a second surface, the first and second surfaces of the end wall defining an end receiving channel.

5. The apparatus of claim 4, wherein the end receiving channel comprises a first end receiving channel and a second end receiving channel, the first end receiving channel in communication with the first receiving channel and the second end receiving channel in communication with the second receiving channel.

6. The apparatus of claim 4, further comprising a medial wall disposed between the first and second ends, the medial wall coupled to the first surface of the first leg and the first surface of the second leg and disposed substantially parallel to the end wall.

7. The apparatus of claim 1, further comprising:

a first projection extending from the first leg and disposed proximate to the first receiving groove; and a second projection extending from the second leg and disposed proximate to the second receiving groove.

8. The apparatus of claim 7, wherein the first projection comprises a first biasing member and the second projection comprises a second biasing member.

9. The apparatus of claim 1, wherein the first channel is disposed substantially perpendicular to the first receiving groove and the second channel is disposed substantially perpendicular to the second receiving groove.

10. The apparatus of claim 1, further comprising an injection port in communication with the first and second receiving grooves.

11. The apparatus of claim 1, further comprising:

a first expulsion port in communication with the first receiving groove; and a second expulsion port in communication with the second receiving groove.

12. An assembly adapted to be fixed to a structural support, comprising:

a frame member comprising a first end and a second end, the first end comprising:

a web;

a first flange and a second flange, the first and second flange coupled to the web;

a third flange coupled to the web, the third flange disposed opposite the second flange;

a first flange rib depending from the first flange;

a first rib and a second rib, the first and second ribs depending from the web;

an end channel depending from the web; and a plurality of slots formed by the web, the first and second flanges, the first flange rib, the first and second ribs, and the end channel; and a corner key comprising:

a first end and a second end opposite the first end;

a first leg disposed between the first and second ends, the first leg being adapted to receive the frame member;

a second leg disposed between the first and second ends;

a first receiving groove disposed in the first leg and forming a first pathway;

a second receiving groove disposed in the second leg and forming a second pathway; and a nailing fin coupled to at least one of the first and second legs, wherein the nailing fin is adapted to be positioned adjacent the structural support and secured thereto with a fastener received through the nailing fin.

13. The assembly of claim 12, the corner key further comprising:

a plurality of first projections extending from the first leg and disposed proximate to the first receiving groove; and a plurality of second projections extending from the second leg and disposed proximate to the second receiving groove, the plurality of slots adapted to receive the plurality of first and second projections.

14. The assembly of claim 13, wherein at least one of the plurality of first projections comprises a first biasing member and at least one of the plurality of second projections comprises a second biasing member, the first and second biasing members adapted to exert a biasing force against the frame member.

15. The assembly of claim 12, further comprising:

a first receiving channel coupled to and in communication with the first receiving groove, the first receiving channel disposed substantially perpendicular to the first receiving groove, the first receiving groove and the first receiving channel adapted to couple with the first end of the frame member; and a second receiving channel coupled to and in communication with the second receiving groove, the second receiving channel disposed substantially perpendicular to the second receiving groove, the second receiving groove and the second receiving channel adapted to couple with the second end of the frame member.

16. The assembly of claim 15, wherein the first receiving groove and the first receiving channel are adapted to receive the web and the third flange.

17. The assembly of claim 15, wherein the first leg comprises a first surface and a second surface and the second leg comprises a first surface and a second surface, the second leg disposed substantially perpendicular to the first leg, and wherein the first surface of the first leg is disposed adjacent to the first surface of the second leg and the second surface of the first leg is disposed adjacent to the second surface of the second leg.

18. The assembly of claim 17, further comprising an end wall substantially coplanar with the second end, the end wall coupled to the first surface of the first leg and the first surface of the second leg.

19. The assembly of claim 18, wherein the end wall comprises a first surface and a second surface, the first and second surfaces of the end wall defining an end receiving channel adapted to receive the first flange.

20. The assembly of claim 19, wherein the end receiving channel comprises a first end receiving channel and a second end receiving channel, the first end receiving channel in communication with the first receiving channel and the second end receiving channel in communication with the second receiving channel.

21. The assembly of claim 18, further comprising a medial wall disposed between the first and second ends, the medial wall coupled to the first surface of the first leg and the first surface of the second leg and disposed substantially parallel to the end wall.

22. The assembly of claim 12, further comprising an injection port in communication with the first and second receiving grooves.

23. The assembly of claim 12, further comprising a first expulsion port in communication with the first receiving groove and a second expulsion port in communication with the second receiving groove.

* * * * *

UNITED STATES PATENT AND TRADEMARK OFFICE

CERTIFICATE OF CORRECTION

PATENT NO. : 7,614,188 B2
APPLICATION NO. : 10/793322
DATED : November 10, 2009
INVENTOR(S) : Richard W. Hetherington and Kevin A. Campbell It is certified that error appears in the above-identified patent and that said Letters Patent is hereby corrected as shown below:

In Column 1, Line 28, please replace "tom" with --torn--.

In Column 5, Line 44, after "43", please insert --to--.

In Column 5, Line 64, after "53", please insert --to--.

In Column 6, Line 24, after "59", please insert --is--.

In Column 11, Line 12, please delete "an".

In Column 13, Line 42, please replace "10" with --100--.

In Column 14, Line 20, please replace "10" with --100--.

In Column 22, Line 57 Claim 12, please replace "flange" with --flanges--.

Signed and Sealed this

Ninth Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,614,188 B2
APPLICATION NO. : 10/793322
DATED : November 10, 2009
INVENTOR(S) : Hetherington et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1088 days.

Signed and Sealed this

Nineteenth Day of October, 2010

David J. Kappos

David J. Kappos
*Director of the United States Patent and Trademark Office*